US011499409B2

(12) United States Patent
Suryadi et al.

(10) Patent No.: US 11,499,409 B2
(45) Date of Patent: Nov. 15, 2022

(54) DYNAMIC SYSTEM FOR FIELD MOTOR OPERATIONS

(71) Applicant: Schlumberger Technology Corporation, Sugar Land, TX (US)

(72) Inventors: Hendrik Suryadi, Beijing (CN); Paul Bolchover, Beijing (CN); Tao Yu, Beijing (CN); Ji Tang Liu, Beijing (CN); Chao Mu, Beijing (CN); Rongbing Chen, Beijing (CN)

(73) Assignee: Schlumberger Technology Corporation, Sugar Land, TX (US)

( * ) Notice: Subject to any disclaimer, the term of this patent is extended or adjusted under 35 U.S.C. 154(b) by 599 days.

(21) Appl. No.: 16/408,514

(22) Filed: May 10, 2019

(65) Prior Publication Data

US 2019/0345808 A1 Nov. 14, 2019

Related U.S. Application Data

(60) Provisional application No. 62/790,970, filed on Jan. 10, 2019, provisional application No. 62/670,333, filed on May 11, 2018.

(51) Int. Cl.
*E21B 44/00* (2006.01)
*E21B 43/12* (2006.01)

(52) U.S. Cl.
CPC ..... *E21B 44/00* (2013.01); *E21B 43/12* (2013.01); *E21B 2200/22* (2020.05)

(58) Field of Classification Search
CPC ..... E21B 44/00; E21B 43/12; E21B 2200/22; E21B 7/067; E21B 4/02
See application file for complete search history.

(56) References Cited

U.S. PATENT DOCUMENTS

2009/0204245 A1* 8/2009 Sustaeta ..... H04L 67/125 700/99
2013/0186687 A1* 7/2013 Snyder ..... E21B 7/04 175/40
2021/0148213 A1* 5/2021 Madasu ..... E21B 49/003

OTHER PUBLICATIONS

Georgios I. Evangelatos, et al., "Advanced BHA-ROP Modeling Including Neural Network Analysis of Drilling Performance Data," IADC/SPE Drilling Conference and Exhibition, pp. 1-24 (Year: 2016).*
Raka Wardana, "Build Rate Prediction Using Artificial Neural Network for Positive Displacement Motor Application in Field X," Jurnal Petro 2018 vol. VII No. 1, Apr. 2018 p. 1-6 (Year: 2018).*
Kingma, Diederik et al., Adam: A Method for Stochastic Optimization, arXiv:1412.6980, v9, Jan. 30, 2017, 15 pages.
Ba, Samba et al., Positive Displacement Motor Modeling: Skyrocketing the Way We Design, Select, and Operate Mud Motors, Society of Petroleum Engineers, SPE-183298-MS, Abu Dhabi International Petroleum Exhibition & Conference, Abu Dhabi, UAE, Nov. 7-10, 2016, 26 pages.

* cited by examiner

*Primary Examiner* — Steven W Crabb
(74) *Attorney, Agent, or Firm* — Alec J. McGinn

(57) ABSTRACT

A method can include providing a trained drilling motor model trained via machine learning based at least in part on drilling motor simulation results; instantiating a motor engine component with an interface in a computational environment; and, responsive to receipt of a call via the interface, returning drilling motor information based at least in part on the trained drilling motor model.

20 Claims, 31 Drawing Sheets

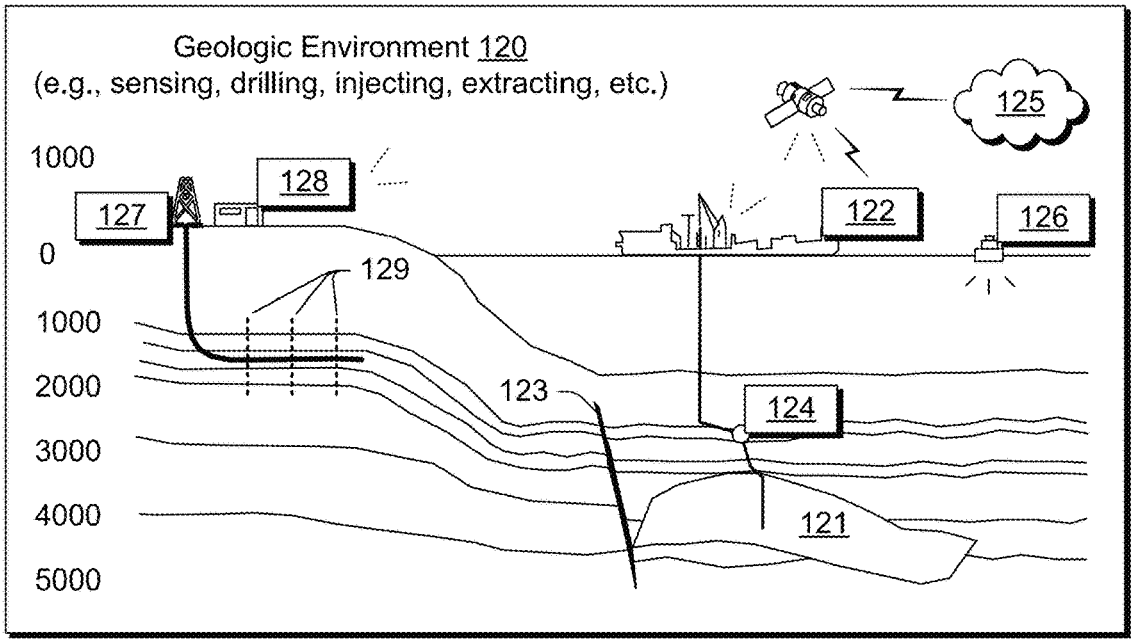
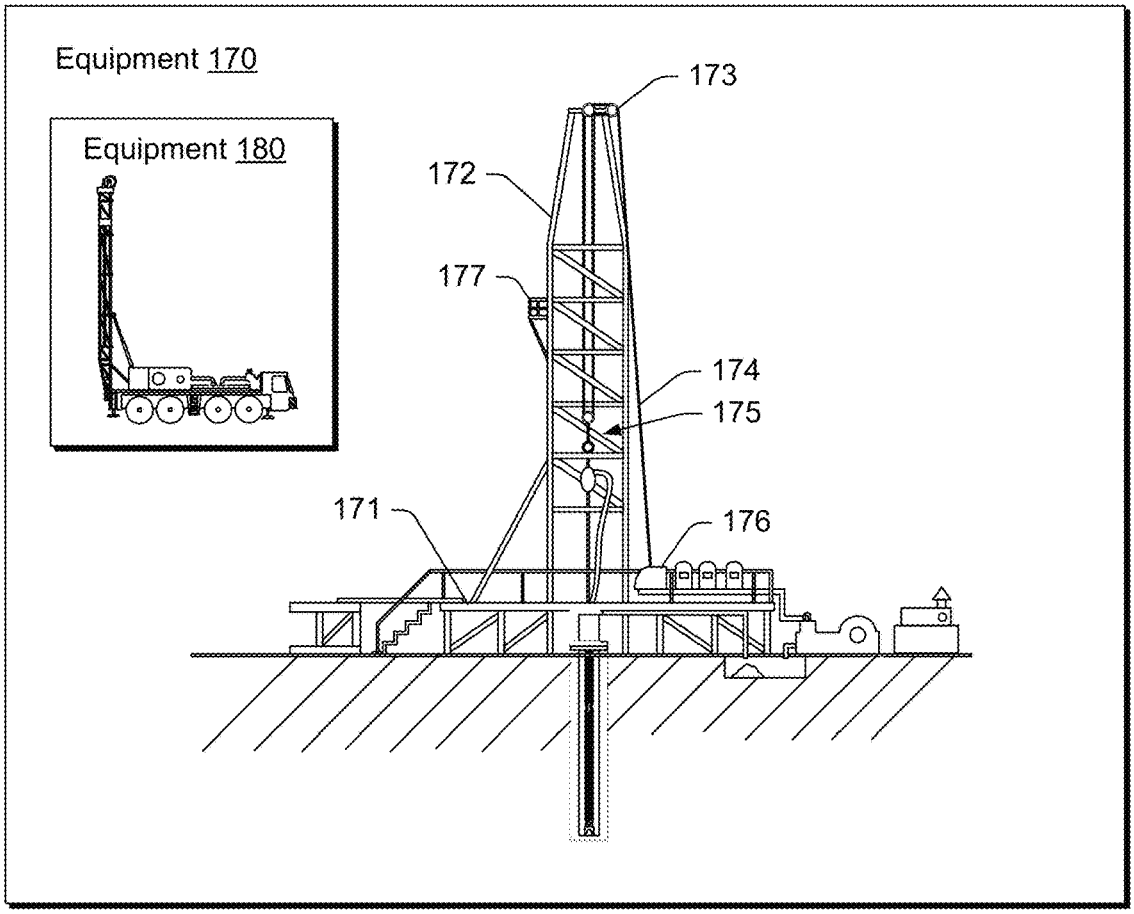
Fig. 1

Point Spreadsheet 570

| x | y | Depth | Pad Config. | Pad Orient. | Well Length | Vertical Spacing | Horiz. Spacing | Toe Height | Step Out | Initial Incl. | Kick Off |
|---|---|---|---|---|---|---|---|---|---|---|---|
| 11 | 93 | 217 | 2 | 90 | 2000 | 50 | 500 | 0 | 1000 | 0 | 0 |
| 11 | 94 | 384 | 1 | 90 | 1000 | 50 | 500 | 0 | 1000 | 0 | 0 |
| 12 | 95 | 282 | 1 | 90 | 1000 | 50 | 500 | 0 | 1000 | 0 | 0 |

1400

Elastomer Recommendations

| Order | Elastomer | Score |
|---|---|---|
| 1 | NBR-1A | 88 |
| 2 | NBR-HR | 86 |
| 3 | HN234 | 83 |

Motor Dimensions

| | |
|---|---|
| Stator Minor Diameter: | 5.553 in |
| Normalized Stator Minor Diameter (70 F / 21 C): | 5.556 in |
| Normalized Stator Minor Diameter (75 F / 24 C): | 5.554 in |
| Rotor Mean Diameter: | 5.556 in |

Rotor and Stator Fits

| | |
|---|---|
| Measured Interference: | 0.013 in |
| Required Interference: | 0.020 in |
| Normalized Measured Interference (70 F / 21 C): | 0.010 in |
| Normalized Demanded Interference (70 F / 21 C): | 0.017 in |

Negative values indicate clearance fit / positive values indicate interference fit Recommended tolerance = Demanded interference +/- 0.015 in (for std power sections)

Fit Validity Range

| | |
|---|---|
| Minimum Fit Validity Temperature | 0 C |
| Maximum Fit Validity Temperature | 38 C |

Fig. 14

Machine Learning Model 2210
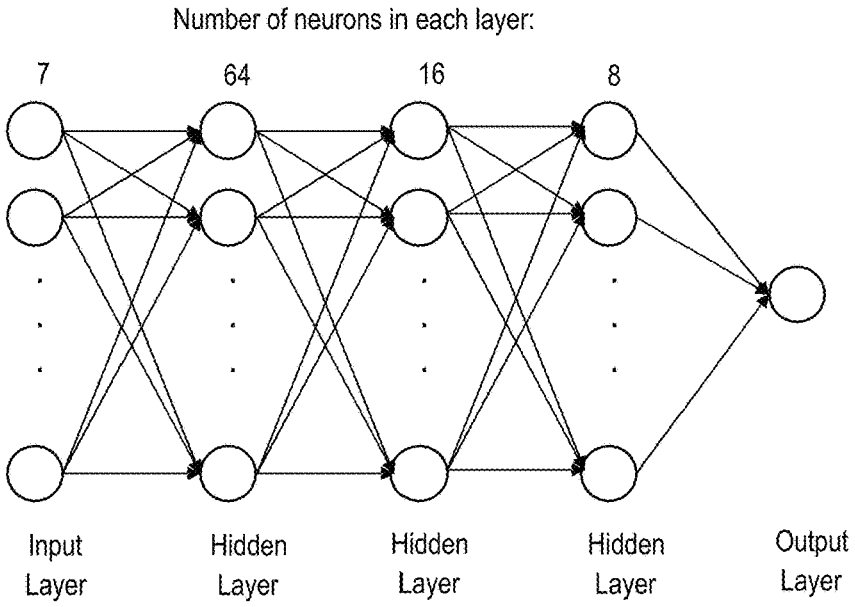
2230
Activation Function: ReLU
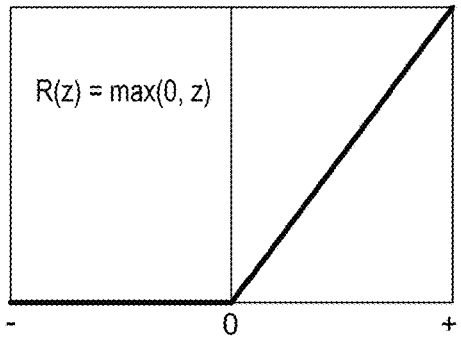
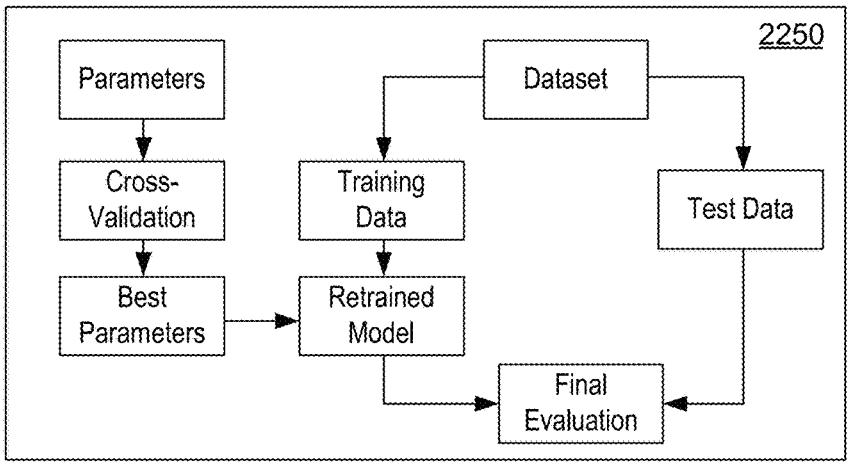
Fig. 22

2600

| | Min Calculation Time | Max Calculation Time | Average Calculation Time |
|---|---|---|---|
| Benchmark | 4.9s | 20091.0s | 1971.0s |
| Smart Depth | 2.6s | 2002.5s | 182.7s |
| Time Saving | 48% | 90% | 91% |

Fig. 26

2800

| | Median Error (RPM) | Median Error (Torque) | Median Error (Fatigue Life) |
|---|---|---|---|
| Power Section 1 | 0.92% | 0.47% | 3.06% |
| Power Section 2 | 0.56% | 0.30% | 2.73% |
| Power Section 3 | 0.61% | 0.30% | 2.34% |

Fig. 28

DYNAMIC SYSTEM FOR FIELD MOTOR OPERATIONS

RELATED APPLICATIONS

This application claims priority to and the benefit of a US Provisional Application having Ser. No. 62/670,333, filed 11 May 2018, which is incorporated by reference herein, and this application claims priority to and the benefit of a US Provisional Application having Ser. No. 62/790,970, filed 10 Jan. 2019, which is incorporated by reference herein.

BACKGROUND

A resource field can be an accumulation, pool or group of pools of one or more resources (e.g., oil, gas, oil and gas) in a subsurface environment. A resource field can include at least one reservoir. A reservoir may be shaped in a manner that can trap hydrocarbons and may be covered by an impermeable or sealing rock. A bore can be drilled into an environment where the bore may be utilized to form a well that can be utilized in producing hydrocarbons from a reservoir.

A rig can be a system of components that can be operated to form a bore in an environment, to transport equipment into and out of a bore in an environment, etc. As an example, a rig can include a system that can be used to drill a bore and to acquire information about an environment, about drilling, etc. A resource field may be an onshore field, an offshore field or an on- and offshore field. A rig can include components for performing operations onshore and/or offshore. A rig may be, for example, vessel-based, offshore platform-based, onshore, etc.

Field planning and/or development can occur over one or more phases, which can include an exploration phase that aims to identify and assess an environment (e.g., a prospect, a play, etc.), which may include drilling of one or more bores (e.g., one or more exploratory wells, etc.).

SUMMARY

A method can include providing a trained drilling motor model trained via machine learning based at least in part on drilling motor simulation results; instantiating a motor engine component with an interface in a computational environment; and, responsive to receipt of a call via the interface, returning drilling motor information based at least in part on the trained drilling motor model. As an example, a system can include a processor; memory accessible by the processor; processor-executable instructions stored in the memory and executable to instruct the system to: provide a trained drilling motor model trained via machine learning based at least in part on drilling motor simulation results; instantiate a motor engine component with an interface in a computational environment; and, responsive to receipt of a call via the interface, return drilling motor information based at least in part on the trained drilling motor model. As an example, one or more computer-readable storage media can include processor-executable instructions to instruct a computing system to: provide a trained drilling motor model trained via machine learning based at least in part on drilling motor simulation results; instantiate a motor engine component with an interface in a computational environment; and, responsive to receipt of a call via the interface, return drilling motor information based at least in part on the trained drilling motor model. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

FIG. 1 illustrates examples of equipment in a geologic environment;

FIG. 14 illustrates an example of a graphical user interface;

FIG. 22 illustrates an example of a neural network architecture and an example of an activation function;

FIG. 26 illustrates an example of a table that includes computational system data;

FIG. 28 illustrates an example of a table that includes values;

DETAILED DESCRIPTION

Figure 2:
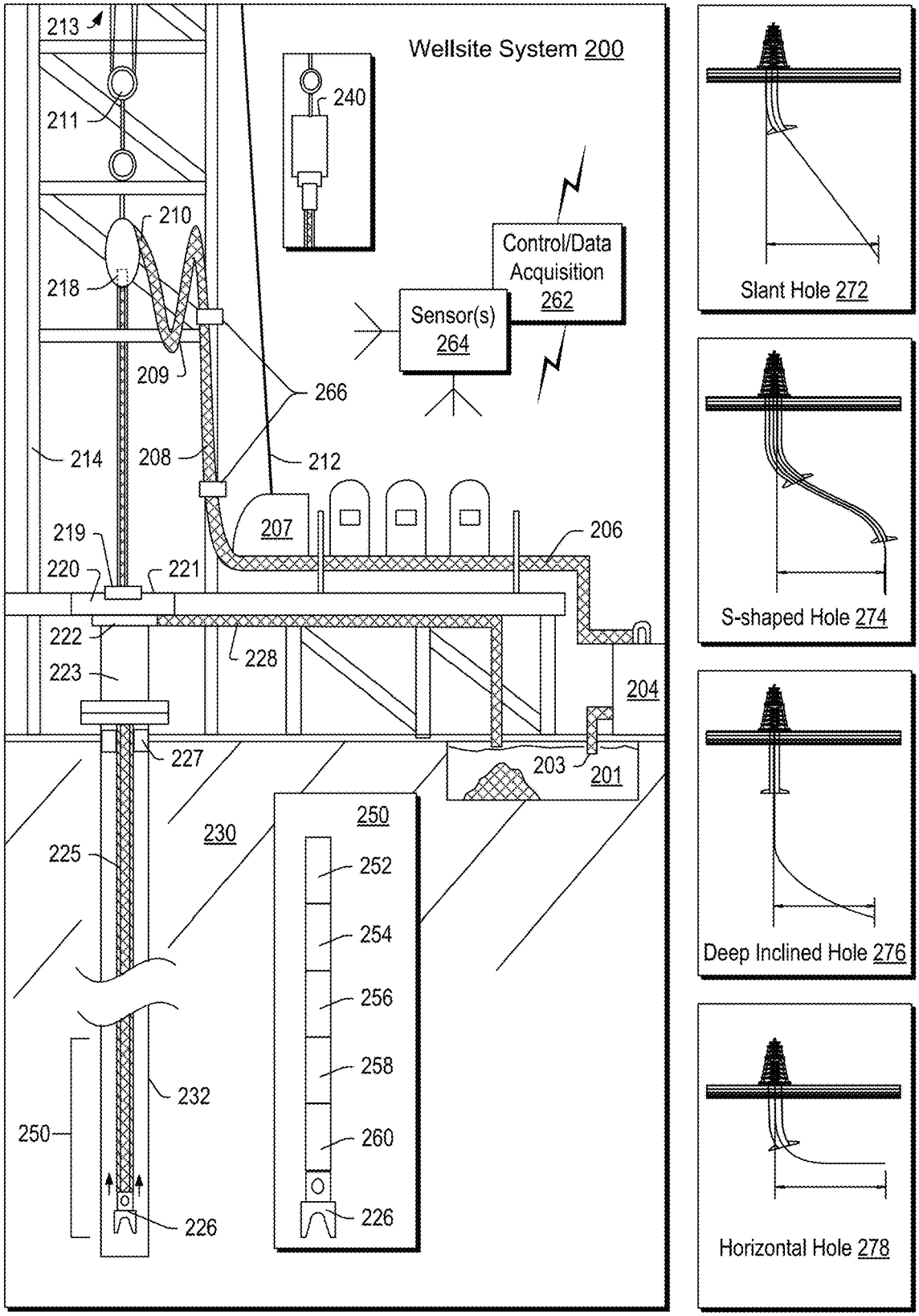
FIG. 2 illustrates examples of equipment and examples of hole types.

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, injection, production, etc. As an example, the equipment 127 and/or 128 may provide for measurement, collection, communication, storage, analysis, etc. of data such as, for example, production data (e.g., for one or more produced resources). As an example, one or more satellites may be provided for purposes of communications, data acquisition, etc.

FIG. 1 also shows an example of equipment 170 and an example of equipment 180. Such equipment, which may be systems of components, may be suitable for use in the geologic environment 120. While the equipment 170 and 180 are illustrated as land-based, various components may be suitable for use in an offshore system.

The equipment 170 includes a platform 171, a derrick 172, a crown block 173, a line 174, a traveling block assembly 175, drawworks 176 and a landing 177 (e.g., a monkeyboard). As an example, the line 174 may be controlled at least in part via the drawworks 176 such that the traveling block assembly 175 travels in a vertical direction with respect to the platform 171. For example, by drawing the line 174 in, the drawworks 176 may cause the line 174 to run through the crown block 173 and lift the traveling block assembly 175 skyward away from the platform 171; whereas, by allowing the line 174 out, the drawworks 176 may cause the line 174 to run through the crown block 173 and lower the traveling block assembly 175 toward the platform 171. Where the traveling block assembly 175 carries pipe (e.g., casing, etc.), tracking of movement of the traveling block 175 may provide an indication as to how much pipe has been deployed.

A derrick can be a structure used to support a crown block and a traveling block operatively coupled to the crown block at least in part via line. A derrick may be pyramidal in shape and offer a suitable strength-to-weight ratio. A derrick may be movable as a unit or in a piece by piece manner (e.g., to be assembled and disassembled).

As an example, drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line can cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

As an example, a crown block can include a set of pulleys (e.g., sheaves) that can be located at or near a top of a derrick or a mast, over which line is threaded. A traveling block can include a set of sheaves that can be moved up and down in a derrick or a mast via line threaded in the set of sheaves of the traveling block and in the set of sheaves of a crown block. A crown block, a traveling block and a line can form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

As an example, a derrickman may be a rig crew member that works on a platform attached to a derrick or a mast. A derrick can include a landing on which a derrickman may stand. As an example, such a landing may be about 10 meters or more above a rig floor. In an operation referred to as trip out of the hole (TOH), a derrickman may wear a safety harness that enables leaning out from the work landing (e.g., monkeyboard) to reach pipe located at or near the center of a derrick or a mast and to throw a line around the pipe and pull it back into its storage location (e.g., fingerboards), for example, until it may be desirable to run the pipe back into the bore. As an example, a rig may include automated pipe-handling equipment such that the derrickman controls the machinery rather than physically handling the pipe.

As an example, a trip may refer to the act of pulling equipment from a bore and/or placing equipment in a bore. As an example, equipment may include a drillstring that can be pulled out of a hole and/or placed or replaced in a hole. As an example, a pipe trip may be performed where a drill bit has dulled or has otherwise ceased to drill efficiently and is to be replaced.

FIG. 2 shows an example of a wellsite system 200 (e.g., at a wellsite that may be onshore or offshore). As shown, the wellsite system 200 can include a mud tank 201 for holding mud and other material (e.g., where mud can be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use directional drilling.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 can provide for operation of the drillstring 225 and other operations. As shown, the wellsite system 200 includes the traveling block 211 and the derrick 214 positioned over the borehole 232. As mentioned, the wellsite system 200 can include the rotary table 220 where the drillstring 225 pass through an opening in the rotary table 220.

As shown in the example of FIG. 2, the wellsite system 200 can include the kelly 218 and associated components, etc., or a top drive 240 and associated components. As to a kelly example, the kelly 218 may be a square or hexagonal metal/alloy bar with a hole drilled therein that serves as a mud flow path. The kelly 218 can be used to transmit rotary motion from the rotary table 220 via the kelly drive bushing 219 to the drillstring 225, while allowing the drillstring 225 to be lowered or raised during rotation. The kelly 218 can pass through the kelly drive bushing 219, which can be driven by the rotary table 220. As an example, the rotary table 220 can include a master bushing that operatively couples to the kelly drive bushing 219 such that rotation of the rotary table 220 can turn the kelly drive bushing 219 and hence the kelly 218. The kelly drive bushing 219 can include an inside profile matching an outside profile (e.g., square, hexagonal, etc.) of the kelly 218; however, with slightly larger dimensions so that the kelly 218 can freely move up and down inside the kelly drive bushing 219.

As to a top drive example, the top drive 240 can provide functions performed by a kelly and a rotary table. The top drive 240 can turn the drillstring 225. As an example, the top drive 240 can include one or more motors (e.g., electric and/or hydraulic) connected with appropriate gearing to a short section of pipe called a quill, that in turn may be screwed into a saver sub or the drillstring 225 itself. The top drive 240 can be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 can hold mud, which can be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via a the lines 206, 208 and 209 to a port of the kelly 218 or, for example, to a port of the top drive 240. The mud can then flow via a passage (e.g., or passages) in the drillstring 225 and out of ports located on the drill bit 226 (see, e.g., a directional arrow). As the mud exits the drillstring 225 via ports in the drill bit 226, it can then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drill string 225 may be pulled from a wellbore and optionally replaced, for example, with a new or sharpened drill bit, a smaller diameter drill string, etc. As mentioned, the act of pulling a drill string out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drill string 225 at a bottom of a wellbore, pumping of the mud commences to lubricate the drill bit 226 for purposes of drilling to enlarge the wellbore. As mentioned, the mud can be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud can cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measuring-while-drilling (MWD) module 256, an optional module 258, a roto-steerable system and motor 260, and the drill bit 226. Such components or modules may be referred to as tools where a drillstring can include a plurality of tools.

The LWD module 254 may be housed in a suitable type of drill collar and can contain one or a plurality of selected types of logging tools. It will also be understood that more than one LWD and/or MWD module can be employed, for example, as represented at by the module 256 of the drillstring assembly 250. Where the position of an LWD module is mentioned, as an example, it may refer to a module at the position of the LWD module 254, the module 256, etc. An LWD module can include capabilities for measuring, processing, and storing information, as well as for communicating with the surface equipment. In the illustrated example, the LWD module 254 may include a seismic measuring device.

The MWD module 256 may be housed in a suitable type of drill collar and can contain one or more devices for measuring characteristics of the drillstring 225 and the drill bit 226. As an example, the MWD tool 254 may include equipment for generating electrical power, for example, to power various components of the drillstring 225. As an example, the MWD tool 254 may include the telemetry equipment 252, for example, where the turbine impeller can generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation can include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well can include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring can include a positive displacement motor (PDM).

As an example, a system may be a steerable system and include equipment to perform a method such as geosteering. As an example, a steerable system can include a PDM or a turbine on a lower part of a drillstring which, just above a drill bit, a bent sub can be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment can make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, can allow for implementing a geosteering method. Such a method can include navigating a subsurface environment, for example, to follow a desired route to reach a desired target or targets.

As an example, a drillstring can include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering can include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 can include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 can be provided for tracking pipe, tracking movement of at least a portion of a drillstring, etc.

As an example, the system 200 can include one or more sensors 266 that can sense and/or transmit signals to a fluid conduit such as a drilling fluid conduit (e.g., a drilling mud conduit). For example, in the system 200, the one or more sensors 266 can be operatively coupled to portions of the standpipe 208 through which mud flows. As an example, a downhole tool can generate pulses that can travel through the mud and be sensed by one or more of the one or more sensors 266. In such an example, the downhole tool can include associated circuitry such as, for example, encoding circuitry that can encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 can include a transmitter that can generate signals that can be transmitted downhole via mud (e.g., drilling fluid) as a transmission medium.

As an example, one or more portions of a drillstring may become stuck. The term stuck can refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this can refer to a portion of a drillstring that cannot be rotated or moved axially. As an example, a condition referred to as "differential sticking" can be a condition whereby the drillstring cannot be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking can have time and financial cost.

As an example, a sticking force can be a product of the differential pressure between the wellbore and the reservoir and the area that the differential pressure is acting upon. This means that a relatively low differential pressure (delta p) applied over a large working area can be just as effective in sticking pipe as can a high differential pressure applied over a small area.

As an example, a condition referred to as "mechanical sticking" can be a condition where limiting or prevention of motion of the drillstring by a mechanism other than differential pressure sticking occurs. Mechanical sticking can be caused, for example, by one or more of junk in the hole, wellbore geometry anomalies, cement, keyseats or a buildup of cuttings in the annulus.

Figure 3:
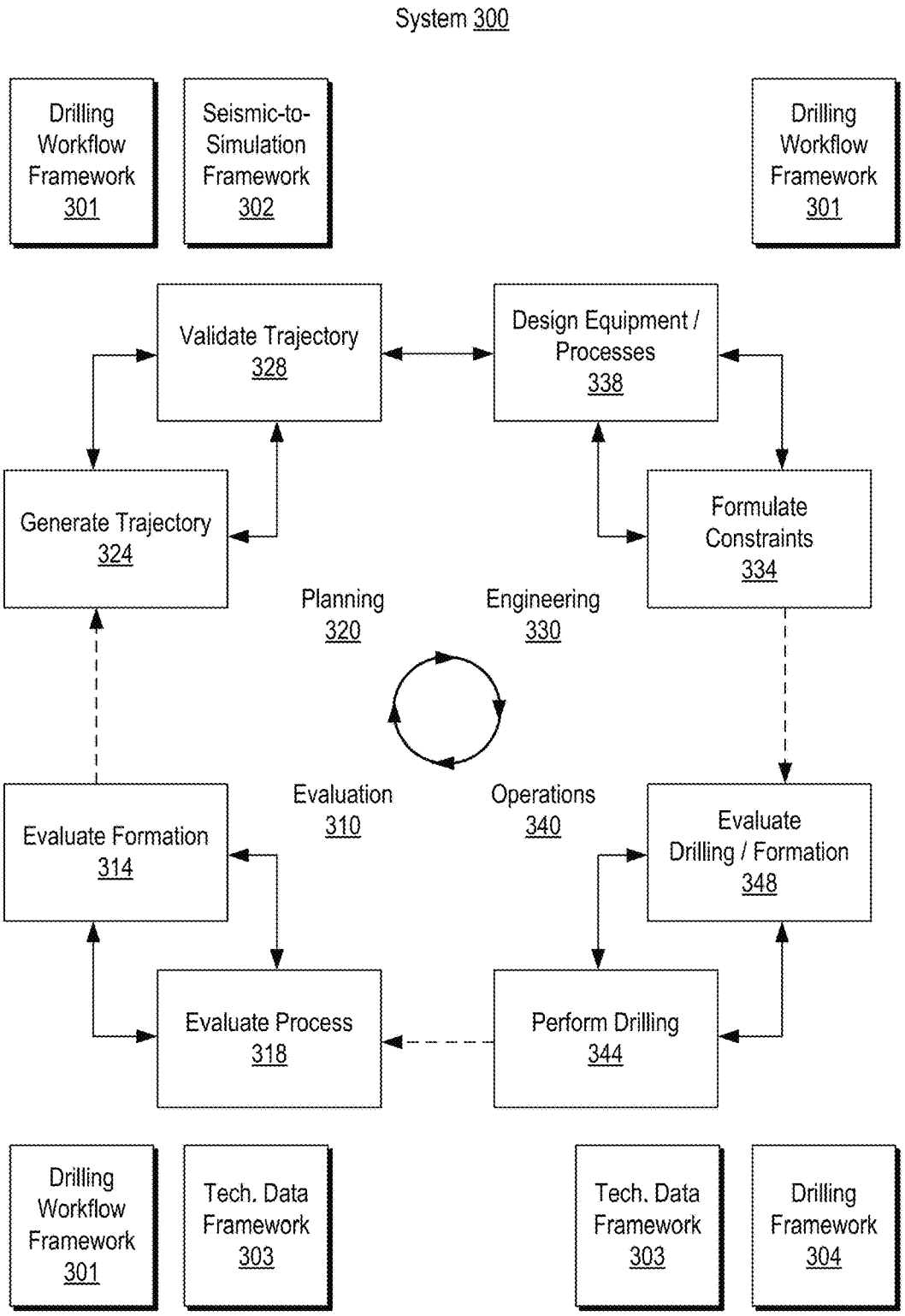
FIG. 3 illustrates an example of a system.

FIG. 3 shows an example of a system 300 that includes various equipment for evaluation 310, planning 320, engineering 330 and operations 340. For example, a drilling workflow framework 301, a seismic-to-simulation framework 302, a technical data framework 303 and a drilling framework 304 may be implemented to perform one or more processes such as a evaluating a formation 314, evaluating a process 318, generating a trajectory 324, validating a trajectory 328, formulating constraints 334, designing equipment and/or processes based at least in part on constraints 338, performing drilling 344 and evaluating drilling and/or formation 348.

In the example of FIG. 3, the seismic-to-simulation framework 302 can be, for example, the PETREL framework (Schlumberger, Houston, Tex.) and the technical data framework 303 can be, for example, the TECH LOG framework (Schlumberger, Houston, Tex.).

As an example, a framework can include entities that may include earth entities, geological objects or other objects such as wells, surfaces, reservoirs, etc. Entities can include virtual representations of actual physical entities that are reconstructed for purposes of one or more of evaluation, planning, engineering, operations, etc.

Entities may include entities based on data acquired via sensing, observation, etc. (e.g., seismic data and/or other information). An entity may be characterized by one or more properties (e.g., a geometrical pillar grid entity of an earth model may be characterized by a porosity property). Such properties may represent one or more measurements (e.g., acquired data), calculations, etc.

A framework may be an object-based framework. In such a framework, entities may include entities based on predefined classes, for example, to facilitate modeling, analysis, simulation, etc. An example of an object-based framework is the MICROSOFT .NET framework (Redmond, Wash.), which provides a set of extensible object classes. In the .NET framework, an object class encapsulates a module of reusable code and associated data structures. Object classes can be used to instantiate object instances for use in by a program, script, etc. For example, borehole classes may define objects for representing boreholes based on well data.

As an example, a framework can include an analysis component that may allow for interaction with a model or model-based results (e.g., simulation results, etc.). As to simulation, a framework may operatively link to or include a simulator such as the ECLIPSE reservoir simulator (Schlumberger, Houston Tex.), the INTERSECT reservoir simulator (Schlumberger, Houston Tex.), etc.

The aforementioned PETREL framework provides components that allow for optimization of exploration and development operations. The PETREL framework includes seismic to simulation software components that can output information for use in increasing reservoir performance, for example, by improving asset team productivity. Through use of such a framework, various professionals (e.g., geophysicists, geologists, well engineers, reservoir engineers, etc.) can develop collaborative workflows and integrate operations to streamline processes. Such a framework may be considered an application and may be considered a data-driven application (e.g., where data is input for purposes of modeling, simulating, etc.).

As an example, one or more frameworks may be interoperative and/or run upon one or another. As an example, consider the framework environment marketed as the OCEAN framework environment (Schlumberger, Houston, Tex.), which allows for integration of add-ons (or plug-ins) into a PETREL framework workflow. In an example embodiment, various components may be implemented as add-ons (or plug-ins) that conform to and operate according to specifications of a framework environment (e.g., according to application programming interface (API) specifications, etc.).

As an example, a framework can include a model simulation layer along with a framework services layer, a framework core layer and a modules layer. The framework may include the OCEAN framework where the model simulation layer can include or operatively link to the PETREL model-centric software package that hosts OCEAN framework applications. In an example embodiment, the PETREL software may be considered a data-driven application. The PETREL software can include a framework for model building and visualization. Such a model may include one or more grids.

As an example, the model simulation layer may provide domain objects, act as a data source, provide for rendering and provide for various user interfaces. Rendering may provide a graphical environment in which applications can display their data while the user interfaces may provide a common look and feel for application user interface components.

As an example, domain objects can include entity objects, property objects and optionally other objects. Entity objects may be used to geometrically represent wells, surfaces, reservoirs, etc., while property objects may be used to provide property values as well as data versions and display parameters. For example, an entity object may represent a well where a property object provides log information as well as version information and display information (e.g., to display the well as part of a model).

As an example, data may be stored in one or more data sources (or data stores, generally physical data storage devices), which may be at the same or different physical sites and accessible via one or more networks. As an example, a model simulation layer may be configured to model projects. As such, a particular project may be stored where stored project information may include inputs, models, results and cases. Thus, upon completion of a modeling session, a user may store a project. At a later time, the project can be accessed and restored using the model simulation layer, which can recreate instances of the relevant domain objects.

As an example, the system 300 may be used to perform one or more workflows. A workflow may be a process that includes a number of worksteps. A workstep may operate on data, for example, to create new data, to update existing data, etc. As an example, a workflow may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable at least in part in the PETREL software, for example, that operates on seismic data, seismic attribute(s), etc.

As an example, seismic data can be data acquired via a seismic survey where sources and receivers are positioned in a geologic environment to emit and receive seismic energy where at least a portion of such energy can reflect off subsurface structures. As an example, a seismic data analysis framework or frameworks (e.g., consider the OMEGA framework, marketed by Schlumberger, Houston, Tex.) may be utilized to determine depth, extent, properties, etc. of subsurface structures. As an example, seismic data analysis can include forward modeling and/or inversion, for example, to iteratively build a model of a subsurface region of a geologic environment. As an example, a seismic data analysis framework may be part of or operatively coupled to a seismic-to-simulation framework (e.g., the PETREL framework, etc.).

As an example, a workflow may be a process implementable at least in part in the OCEAN framework. As an example, a workflow may include one or more worksteps that access a module such as a plug-in (e.g., external executable code, etc.).

As an example, a framework may provide for modeling petroleum systems. For example, the modeling framework marketed as the PETROMOD framework (Schlumberger, Houston, Tex.) includes features for input of various types of information (e.g., seismic, well, geological, etc.) to model evolution of a sedimentary basin. The PETROMOD framework provides for petroleum systems modeling via input of various data such as seismic data, well data and other geological data, for example, to model evolution of a sedimentary basin. The PETROMOD framework may predict if, and how, a reservoir has been charged with hydrocarbons, including, for example, the source and timing of hydrocarbon generation, migration routes, quantities, pore pressure and hydrocarbon type in the subsurface or at surface conditions. In combination with a framework such as the PETREL framework, workflows may be constructed to provide basin-to-prospect scale exploration solutions. Data exchange between frameworks can facilitate construction of models, analysis of data (e.g., PETROMOD framework data analyzed using PETREL framework capabilities), and coupling of workflows.

As an example, a framework may be implemented within or in a manner operatively coupled to the DELFI cognitive exploration and production (E&P) environment (Schlumberger Limited, Houston, Tex.), which is a secure, cognitive, cloud-based collaborative environment that integrates data and workflows with digital technologies, such as artificial intelligence and machine learning. As an example, such an environment can provide for operations that involve one or more computational frameworks. For example, various types of computational frameworks may be utilized within an environment such as a drilling plan framework, a seismic-to-simulation framework (e.g., PETREL framework, Schlumberger Limited, Houston, Tex.), a measurements framework (e.g., TECHLOG framework, Schlumberger Limited, Houston, Tex.), a mechanical earth modeling (MEM) framework (PETROMOD framework, Schlumberger Limited, Houston, Tex.), an exploration risk, resource, and value assessment framework (e.g., GEOX, Schlumberger Limited, Houston, Tex.), a reservoir simulation framework (INTERSECT, Schlumberger Limited, Houston, Tex.), a surface facilities framework (e.g., PIPESIM, Schlumberger Limited, Houston, Tex.), a stimulation framework (MANGROVE framework, Schlumberger Limited, Houston, Tex.). As an example, one or more methods may be implemented at least in part via a framework (e.g., a computational framework) and/or an environment (e.g., a computational environment).

As mentioned, a drillstring can include various tools that may make measurements. As an example, a wireline tool or another type of tool may be utilized to make measurements. As an example, a tool may be configured to acquire electrical borehole images. As an example, the fullbore Formation MicroImager (FMI) tool (Schlumberger, Houston, Tex.) can acquire borehole image data. A data acquisition sequence for such a tool can include running the tool into a borehole with acquisition pads closed, opening and pressing the pads against a wall of the borehole, delivering electrical current into the material defining the borehole while translating the tool in the borehole, and sensing current remotely, which is altered by interactions with the material.

Analysis of formation information may reveal features such as, for example, vugs, dissolution planes (e.g., dissolution along bedding planes), stress-related features, dip events, etc. As an example, a tool may acquire information that may help to characterize a reservoir, optionally a fractured reservoir where fractures may be natural and/or artificial (e.g., hydraulic fractures). As an example, information acquired by a tool or tools may be analyzed using a framework such as the TECHLOG framework. As an example, the TECHLOG framework can be interoperable with one or more other frameworks such as, for example, the PETREL framework.

As an example, various aspects of a workflow may be completed automatically, may be partially automated, or may be completed manually, as by a human user interfacing with a software application. As an example, a workflow may be cyclic, and may include, as an example, four stages such as, for example, an evaluation stage (see, e.g., the evaluation equipment 310), a planning stage (see, e.g., the planning equipment 320), an engineering stage (see, e.g., the engineering equipment 330) and an execution stage (see, e.g., the operations equipment 340). As an example, a workflow may commence at one or more stages, which may progress to one or more other stages (e.g., in a serial manner, in a parallel manner, in a cyclical manner, etc.).

As an example, a workflow can commence with an evaluation stage, which may include a geological service provider evaluating a formation (see, e.g., the evaluation block 314). As an example, a geological service provider may undertake the formation evaluation using a computing system executing a software package tailored to such activity; or, for example, one or more other suitable geology platforms may be employed (e.g., alternatively or additionally). As an example, the geological service provider may evaluate the formation, for example, using earth models, geophysical models, basin models, petrotechnical models, combinations thereof, and/or the like. Such models may take into consideration a variety of different inputs, including offset well data, seismic data, pilot well data, other geologic data, etc. The models and/or the input may be stored in the database maintained by the server and accessed by the geological service provider.

As an example, a workflow may progress to a geology and geophysics ("G&G") service provider, which may generate a well trajectory (see, e.g., the generation block 324), which may involve execution of one or more G&G software packages. Examples of such software packages include the PETREL framework. As an example, a G&G service provider may determine a well trajectory or a section thereof, based on, for example, one or more model(s) provided by a formation evaluation (e.g., per the evaluation block 314), and/or other data, e.g., as accessed from one or more databases (e.g., maintained by one or more servers, etc.). As an example, a well trajectory may take into consideration various "basis of design" (BOD) constraints, such as general surface location, target (e.g., reservoir) location, and the like. As an example, a trajectory may incorporate information about tools, bottom-hole assemblies, casing sizes, etc., that may be used in drilling the well. A well trajectory determination may take into consideration a variety of other parameters, including risk tolerances, fluid weights and/or plans, bottom-hole pressures, drilling time, etc.

As an example, a workflow may progress to a first engineering service provider (e.g., one or more processing machines associated therewith), which may validate a well trajectory and, for example, relief well design (see, e.g., the validation block 328). Such a validation process may include evaluating physical properties, calculations, risk tolerances, integration with other aspects of a workflow, etc. As an example, one or more parameters for such determinations may be maintained by a server and/or by the first engineering service provider; noting that one or more model(s), well trajectory(ies), etc. may be maintained by a server and accessed by the first engineering service provider. For example, the first engineering service provider may include one or more computing systems executing one or more software packages. As an example, where the first engineering service provider rejects or otherwise suggests an adjustment to a well trajectory, the well trajectory may be adjusted or a message or other notification sent to the G&G service provider requesting such modification.

As an example, one or more engineering service providers (e.g., first, second, etc.) may provide a casing design, bottom-hole assembly (BHA) design, fluid design, and/or the like, to implement a well trajectory (see, e.g., the design block 338). In some embodiments, a second engineering service provider may perform such design using one of more software applications. Such designs may be stored in one or more databases maintained by one or more servers, which may, for example, employ STUDIO (Schlumberger, Houston, Tex.) framework tools, and may be accessed by one or more of the other service providers in a workflow.

As an example, a second engineering service provider may seek approval from a third engineering service provider for one or more designs established along with a well trajectory. In such an example, the third engineering service provider may consider various factors as to whether the well engineering plan is acceptable, such as economic variables (e.g., oil production forecasts, costs per barrel, risk, drill time, etc.), and may request authorization for expenditure, such as from the operating company's representative, well-owner's representative, or the like (see, e.g., the formulation block 334). As an example, at least some of the data upon which such determinations are based may be stored in one or more database maintained by one or more servers. As an example, a first, a second, and/or a third engineering service provider may be provided by a single team of engineers or even a single engineer, and thus may or may not be separate entities.

As an example, where economics may be unacceptable or subject to authorization being withheld, an engineering service provider may suggest changes to casing, a bottom-hole assembly, and/or fluid design, or otherwise notify and/or return control to a different engineering service provider, so that adjustments may be made to casing, a bottom-hole assembly, and/or fluid design. Where modifying one or more of such designs is impracticable within well constraints, trajectory, etc., the engineering service provider may suggest an adjustment to the well trajectory and/or a workflow may return to or otherwise notify an initial engineering service provider and/or a G&G service provider such that either or both may modify the well trajectory.

As an example, a workflow can include considering a well trajectory, including an accepted well engineering plan, and a formation evaluation. Such a workflow may then pass control to a drilling service provider, which may implement the well engineering plan, establishing safe and efficient drilling, maintaining well integrity, and reporting progress as well as operating parameters (see, e.g., the blocks 344 and 348). As an example, operating parameters, formation encountered, data collected while drilling (e.g., using logging-while-drilling or measuring-while-drilling technology), may be returned to a geological service provider for evaluation. As an example, the geological service provider may then re-evaluate the well trajectory, or one or more other aspects of the well engineering plan, and may, in some cases, and potentially within predetermined constraints, adjust the well engineering plan according to the real-life drilling parameters (e.g., based on acquired data in the field, etc.).

Whether the well is entirely drilled, or a section thereof is completed, depending on the specific embodiment, a workflow may proceed to a post review (see, e.g., the evaluation block 318). As an example, a post review may include reviewing drilling performance. As an example, a post review may further include reporting the drilling performance (e.g., to one or more relevant engineering, geological, or G&G service providers).

Various activities of a workflow may be performed consecutively and/or may be performed out of order (e.g., based partially on information from templates, nearby wells, etc. to fill in any gaps in information that is to be provided by another service provider). As an example, undertaking one activity may affect the results or basis for another activity, and thus may, either manually or automatically, call for a variation in one or more workflow activities, work products, etc. As an example, a server may allow for storing information on a central database accessible to various service providers where variations may be sought by communication with an appropriate service provider, may be made automatically, or may otherwise appear as suggestions to the relevant service provider. Such an approach may be considered to be a holistic approach to a well workflow, in comparison to a sequential, piecemeal approach.

As an example, various actions of a workflow may be repeated multiple times during drilling of a wellbore. For example, in one or more automated systems, feedback from a drilling service provider may be provided at or near real-time, and the data acquired during drilling may be fed to one or more other service providers, which may adjust its piece of the workflow accordingly. As there may be dependencies in other areas of the workflow, such adjustments may permeate through the workflow, e.g., in an automated fashion. In some embodiments, a cyclic process may additionally or instead proceed after a certain drilling goal is reached, such as the completion of a section of the wellbore, and/or after the drilling of the entire wellbore, or on a per-day, week, month, etc. basis.

Well planning can include determining a path of a well that can extend to a reservoir, for example, to economically produce fluids such as hydrocarbons therefrom. Well planning can include selecting a drilling and/or completion assembly which may be used to implement a well plan. As an example, various constraints can be imposed as part of well planning that can impact design of a well. As an example, such constraints may be imposed based at least in part on information as to known geology of a subterranean domain, presence of one or more other wells (e.g., actual and/or planned, etc.) in an area (e.g., consider collision avoidance), etc. As an example, one or more constraints may be imposed based at least in part on characteristics of one or more tools, components, etc. As an example, one or more constraints may be based at least in part on factors associated with drilling time and/or risk tolerance.

As an example, a system can allow for a reduction in waste, for example, as may be defined according to LEAN. In the context of LEAN, consider one or more of the following types of waste: transport (e.g., moving items unnecessarily, whether physical or data); inventory (e.g., components, whether physical or informational, as work in process, and finished product not being processed); motion (e.g., people or equipment moving or walking unnecessarily to perform desired processing); waiting (e.g., waiting for information, interruptions of production during shift change, etc.); overproduction (e.g., production of material, information, equipment, etc. ahead of demand); over Processing (e.g., resulting from poor tool or product design creating activity); and defects (e.g., effort involved in inspecting for and fixing defects whether in a plan, data, equipment, etc.). As an example, a system that allows for actions (e.g., methods, workflows, etc.) to be performed in a collaborative manner can help to reduce one or more types of waste.

As an example, a system can be utilized to implement a method for facilitating distributed well engineering, planning, and/or drilling system design across multiple computation devices where collaboration can occur among various different users (e.g., some being local, some being remote, some being mobile, etc.). In such a system, the various users via appropriate devices may be operatively coupled via one or more networks (e.g., local and/or wide area networks, public and/or private networks, land-based, marine-based and/or areal networks, etc.).

As an example, a system may allow well engineering, planning, and/or drilling system design to take place via a subsystems approach where a wellsite system is composed of various subsystem, which can include equipment subsystems and/or operational subsystems (e.g., control subsystems, etc.). As an example, computations may be performed using various computational platforms/devices that are operatively coupled via communication links (e.g., network links, etc.). As an example, one or more links may be operatively coupled to a common database (e.g., a server site, etc.). As an example, a particular server or servers may manage receipt of notifications from one or more devices and/or issuance of notifications to one or more devices. As an example, a system may be implemented for a project where the system can output a well plan, for example, as a digital well plan, a paper well plan, a digital and paper well plan, etc. Such a well plan can be a complete well engineering plan or design for the particular project.

Figure 4:
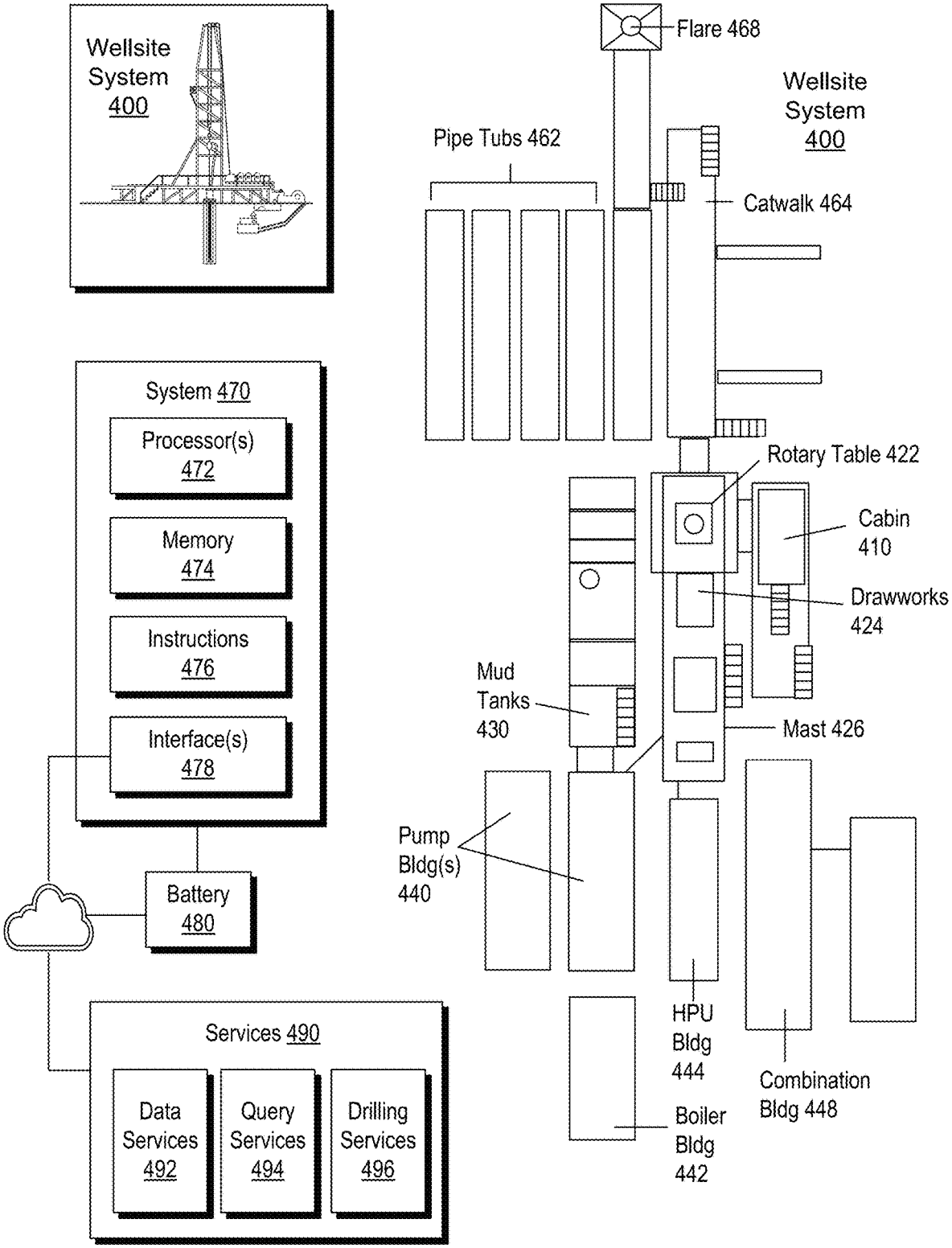
FIG. 4 illustrates an example of a wellsite system and an example of a computing system.

FIG. 4 shows an example of a wellsite system 400, specifically, FIG. 4 shows the wellsite system 400 in an approximate side view and an approximate plan view along with a block diagram of a system 470.

In the example of FIG. 4, the wellsite system 400 can include a cabin 410, a rotary table 422, drawworks 424, a mast 426 (e.g., optionally carrying a top drive, etc.), mud tanks 430 (e.g., with one or more pumps, one or more shakers, etc.), one or more pump buildings 440, a boiler building 442, an HPU building 444 (e.g., with a rig fuel tank, etc.), a combination building 448 (e.g., with one or more generators, etc.), pipe tubs 462, a catwalk 464, a flare 468, etc. Such equipment can include one or more associated functions and/or one or more associated operational risks, which may be risks as to time, resources, and/or humans.

As shown in the example of FIG. 4, the wellsite system 400 can include a system 470 that includes one or more processors 472, memory 474 operatively coupled to at least one of the one or more processors 472, instructions 476 that can be, for example, stored in the memory 474, and one or more interfaces 478. As an example, the system 470 can include one or more processor-readable media that include processor-executable instructions executable by at least one of the one or more processors 472 to cause the system 470 to control one or more aspects of the wellsite system 400. In such an example, the memory 474 can be or include the one or more processor-readable media where the processor-executable instructions can be or include instructions. As an example, a processor-readable medium can be a computer-readable storage medium that is not a signal and that is not a carrier wave.

FIG. 4 also shows a battery 480 that may be operatively coupled to the system 470, for example, to power the system 470. As an example, the battery 480 may be a back-up battery that operates when another power supply is unavailable for powering the system 470. As an example, the battery 480 may be operatively coupled to a network, which may be a cloud network. As an example, the battery 480 can include smart battery circuitry and may be operatively coupled to one or more pieces of equipment via a SMBus or other type of bus.

In the example of FIG. 4, services 490 are shown as being available, for example, via a cloud platform. Such services can include data services 492, query services 494 and drilling services 496. As an example, the services 490 may be part of a system such as the system 300 of FIG. 3.

Figure 5:
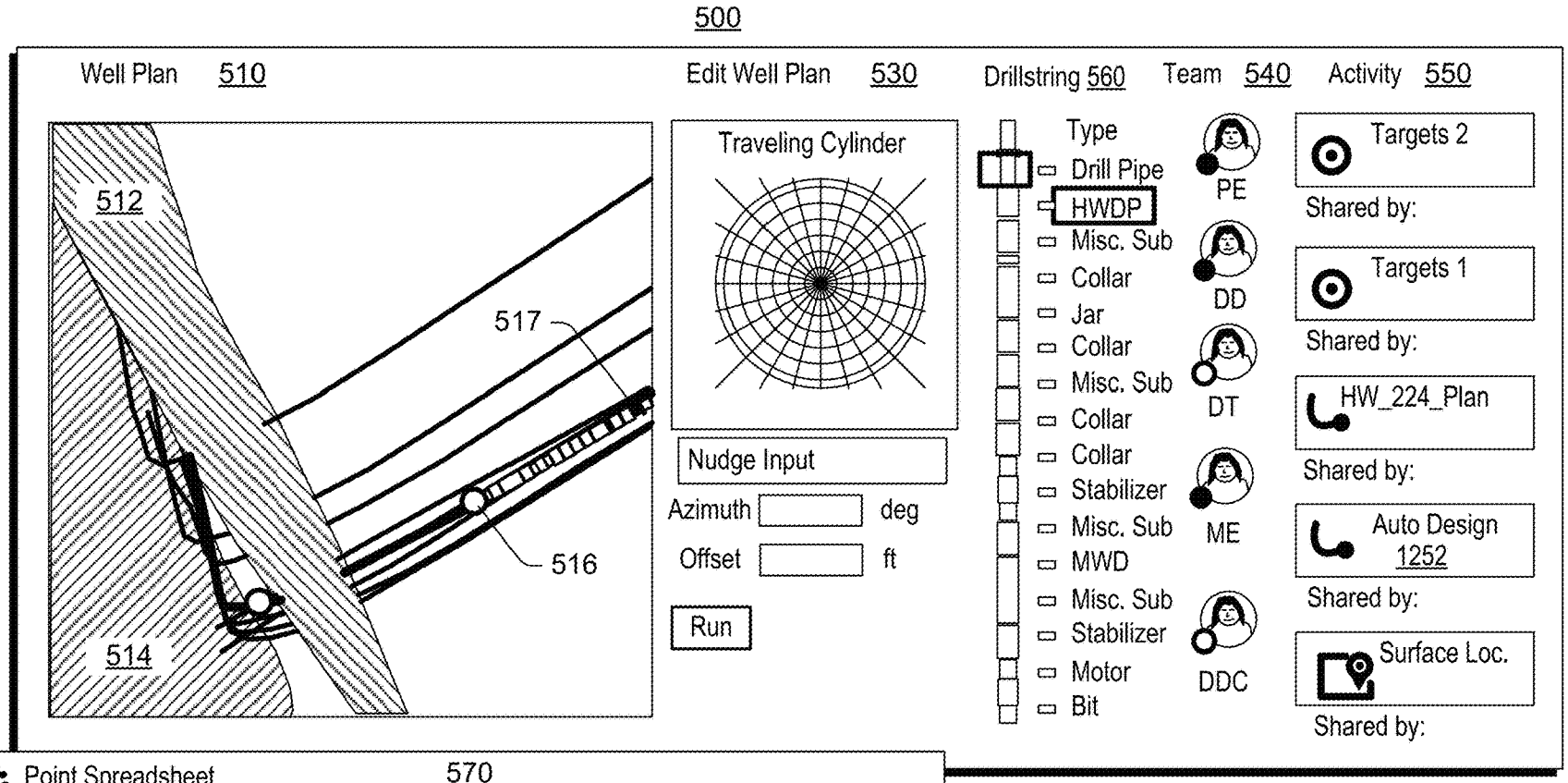
FIG. 5 illustrates an example of a graphical user interface.

FIG. 5 shows an example of a graphical user interface (GUI) 500 that includes information associated with a well plan. Specifically, the GUI 500 includes a panel 510 where surfaces representations 512 and 514 are rendered along with well trajectories where a location 516 can represent a position of a drillstring 517 along a well trajectory. The GUI 500 may include one or more editing features such as an edit well plan set of features 530. The GUI 500 may include information as to individuals of a team 540 that are involved, have been involved and/or are to be involved with one or more operations. The GUI 500 may include information as to one or more activities 550. As shown in the example of FIG. 5, the GUI 500 can include a graphical control of a drillstring 560 where, for example, various portions of the drillstring 560 may be selected to expose one or more associated parameters (e.g., type of equipment, equipment specifications, operational history, etc.). FIG. 5 also shows a table 570 as a point spreadsheet that specifies information for a plurality of wells.

In the example of FIG. 5, the drillstring graphical control 560 includes components such as drill pipe, heavy weight drill pipe (HWDP), subs, collars, jars, stabilizers, motor(s) and a bit. A drillstring can be a combination of drill pipe, a bottom hole assembly (BHA) and one or more other tools, which can include one or more tools that can help a drill bit turn and drill into material (e.g., a formation).

Figure 6:
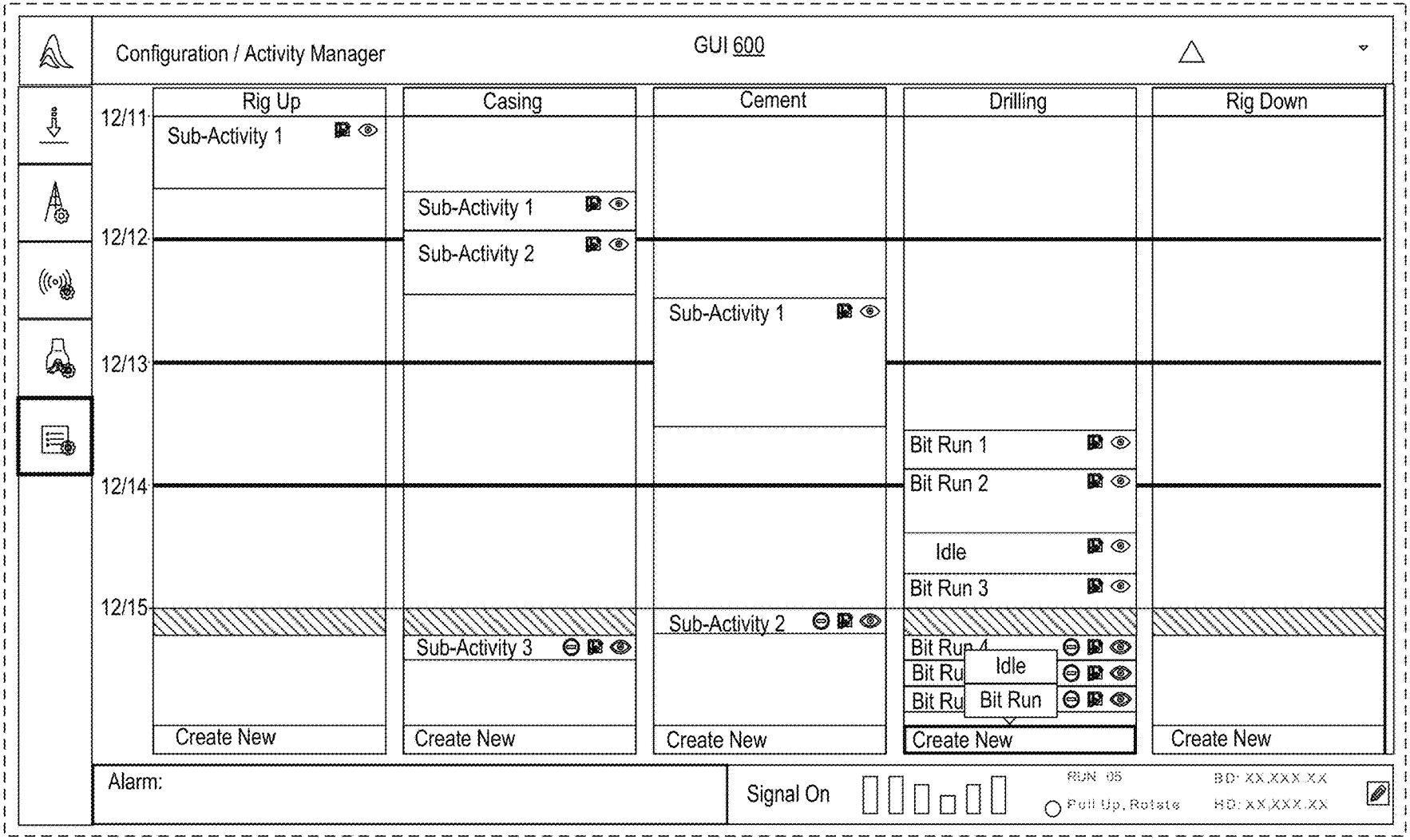
FIG. 6 illustrates an example of a graphical user interface.

FIG. 6 shows an example of a graphical user interface 600 that includes a schedule organized with respect to time (days, dates, etc.) and with respect to various types of operations. The GUI 600 can be part of a well planning system, which may be part of a field development framework. For example, the various operations in the GUI 600 can be implemented to drill at least a portion of a well in a geologic environment (e.g., an oil field or oilfield) where the well may be completed for one or more purposes (e.g., production of hydrocarbons, injection of fluid(s), fracturing of rock, etc.).

As an example, the GUIs 500 and 600 can be part of a field development framework. For example, the well plan 510 of the GUI 500 may be based at least in part on information rendered in the GUI 600. As an example, an interaction with the GUI 500 may be processed by one or more processors to generation information that can be rendered to the GUI 600 and, for example, vice versa.

As an example, a framework may be implemented using computing resources (e.g., hardware, communication equipment, etc.) as may be available, for example, in the cloud, a server, a workstation, etc.

As an example, a framework can include components that can take certain inputs and generate certain outputs. The outputs of a component may be used as inputs of another component or other components such that a real-time workflow can be constructed.

Figure 7:
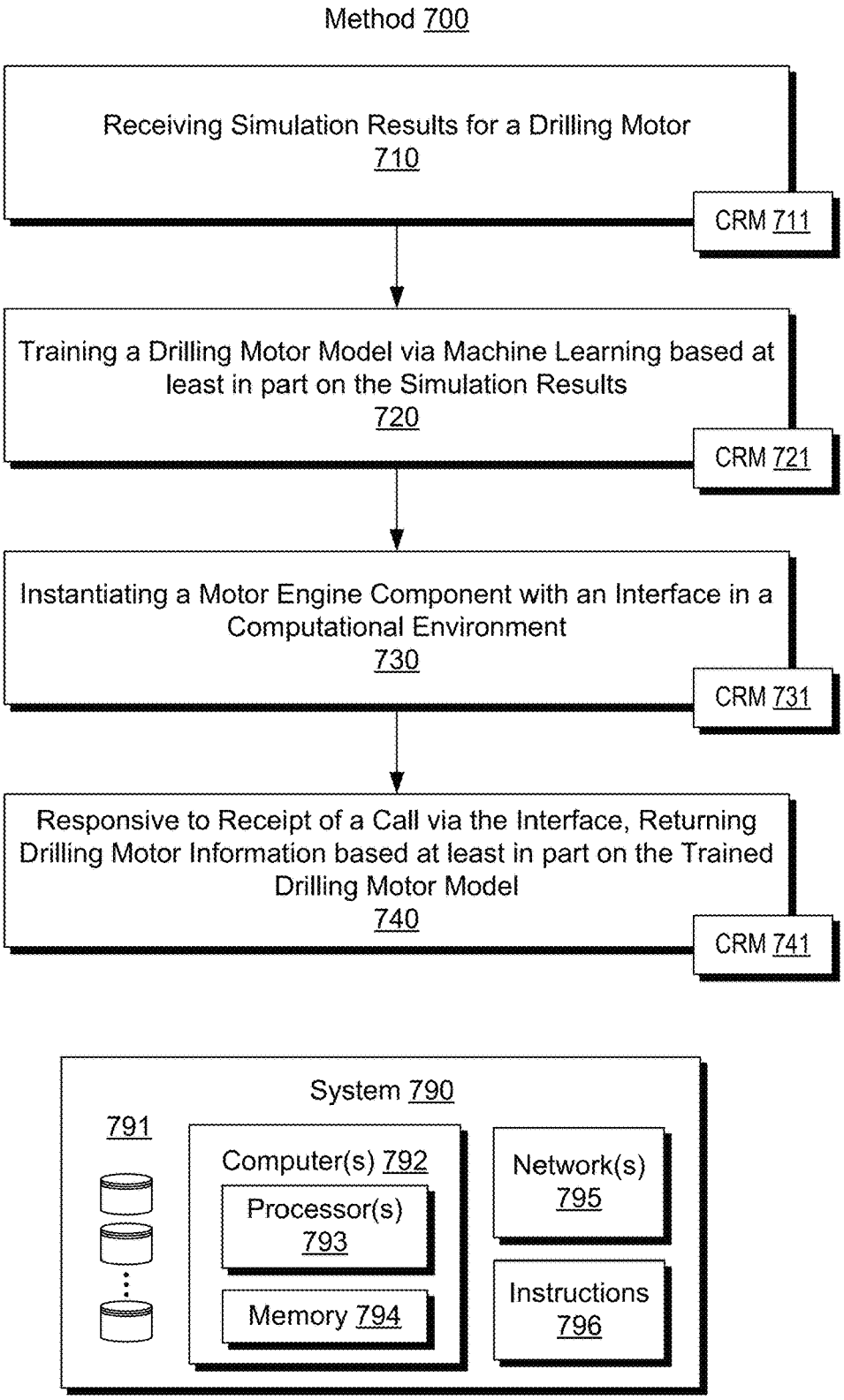
FIG. 7 illustrates an example of a method and an example of a system.

FIG. 7 shows an example of a method 700 and an example of a system 790. The method 710 includes a reception block 710 for receiving simulation results for a drilling motor, a training block 720 for training a drilling motor model via machine learning based at least in part on the simulation results, an instantiation block 730 for instantiating a motor engine component with an interface in a computational environment, and a call and response block 740 for, responsive to receipt of a call via the interface, returning drilling motor information based at least in part on the trained drilling motor model.

FIG. 7 also shows various computer-readable media (CRM) blocks 711, 721, 731, 741, and 751. Such blocks can include instructions that are executable by one or more processors, which can be one or more processors of a computational framework, a system, a computer, etc. A computer-readable medium can be a computer-readable storage medium that is not a signal, not a carrier wave and that is non-transitory. For example, a computer-readable medium can be a physical memory component that can store information in a digital format.

In the example of FIG. 7, a system 790 includes one or more information storage devices 791, one or more computers 792, one or more networks 795 and instructions 796. As to the one or more computers 792, each computer may include one or more processors (e.g., or processing cores) 793 and memory 794 for storing the instructions 796, for example, executable by at least one of the one or more processors. As an example, one or more of the blocks 711, 721, 731, 741 and 751 may optionally be include in the instructions 796 of the system 790. As an example, a computer may include one or more network interfaces (e.g., wired or wireless), one or more graphics cards, a display interface (e.g., wired or wireless), etc.

Figure 8:
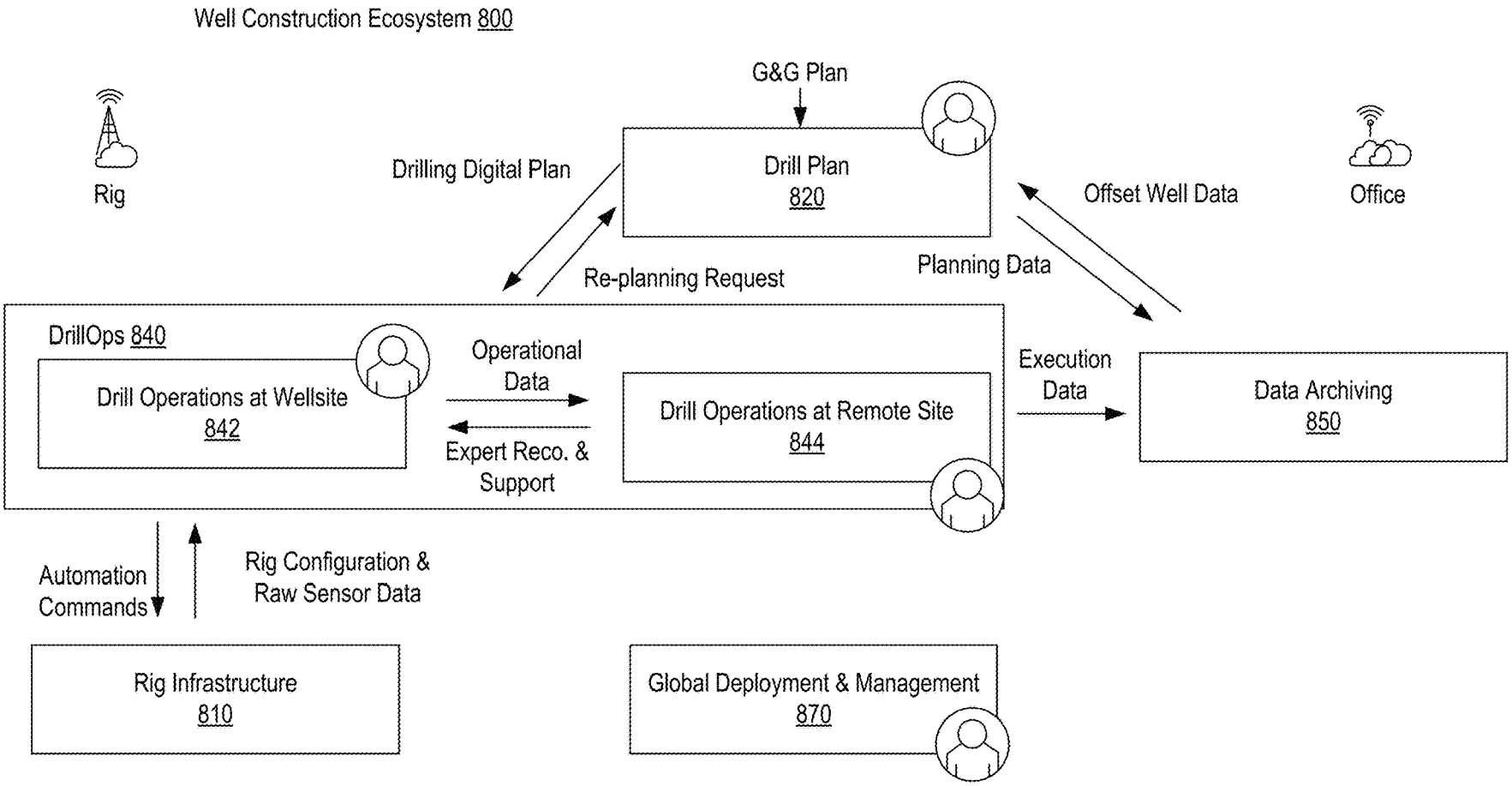
FIG. 8 illustrates an example of a system.

FIG. 8 shows an example of a system 800 that can be a well construction ecosystem. As shown, the system 800 includes rig infrastructure 810 and a drill plan component 820 that can generation or otherwise transmit information associated with a plan to be executed utilizing the rig infrastructure 810, for example, via the drilling operations layer 840, which includes a wellsite component 842 and an offsite component 844. As shown, data acquired and/or generated by the drilling operations layer 840 can be transmitted to a data archiving component 850, which may be utilized, for example, for purposes of planning one or more operations (e.g., per the drilling plan component 820.

As an example, a workflow of motor optimization can select or help to select (e.g., or design) an effective motor for a job, for example, provided the fatigue life of the motor and the operation parameter guidance for drilling performance and reliability.

A method can include motor job optimization via selecting or designing a cost effective motor for the job, providing the fatigue life of the motor and providing the operation parameter guidance for drilling performance & reliability.

Motors can be used as tools of steering a directional drillstring to drill a borehole directionally. One or more motor components can be subject to failure. For example, an elastomer in a motor power section may be prone to fatigue failure in downhole condition, which can be a risk of motor operation and impediment to drilling. A method can evaluate which motor is most suitable (e.g., effective) for a job, which can help to alleviate pitfalls of a human decision process that is based on trial-and-error.

As an example, through machine learning, a framework can create a component that can be referred to as a motor engine. In various examples, such a motor engine performs with an agreement within 98% of simulator results as output by a complex computational simulator as to motor performance. In such an example, the machine learning framework can provide output in less than one second, which is more rapid than the output of the complex computational simulator.

A framework can implement an automatic workflow that integrates computations for bit performance, drilling hydraulics, motor performance and elastomer fatigue. Such a framework can be used to optimize one or more motor jobs. Such a rapid, automatic workflow can be implemented to select or design an effective motor for a drilling job, provide fatigue life of the motor and operation parameter guidance for drilling performance and reliability.

A framework for motor optimization may be implemented in conjunction with (e.g., or part of) the ecosystem 800 of FIG. 8. In such an approach, the framework can make use of existing data and computations and can optionally alleviate a demand for one or more additional inputs, which may make a workflow automatic and industrialized.

As an example, input to a workflow can be various well information such as, for example, one or more of trajectory, wellbore geometry, drilling fluid, formation properties, BHA and bit, etc. Such information can be defined in a well planning application such as the drill planning component of the system 800 of FIG. 8. Output from a framework can be a recommended cost-effective motor for a job, for example, together with an estimated motor fatigue life, and operation parameter guidance for drilling performance and reliability. Such output can help in selection and/or design of an optimal motor for a job.

A framework can implement a workflow that uses machine learning such that a rapid engine (e.g., a "motor engine") is created as a computational component that is a proxy of a computational simulator that tends to have a high computation cost (e.g., 4 hours to 6 hours per simulation run). As an example, a trained engine can provide output that agrees within approximately 98% of the high computation cost simulator results while running much more rapidly (e.g., in less than one second). Such a workflow can integrate computations for bit performance, drilling hydraulics, motor performance and elastomer fatigue. Such an approach can allow a workflow to be industrialized (e.g., set forth in one or more machines rather than via human decision making based on trial and error).

As an example, a workflow can include: issuing a search query for motor candidates to a digital motor catalog; using a hydraulics computational component to simulate downhole temperature and pressure, and motor flow rate; using a drill bit behavior computational component to calculate a drill bit torque versus WOB (weight on bit) curve and a DOC (depth of cut) versus WOB curve; using a motor engine to generate a motor power curve and a fatigue life curve; determining a suitable elastomer type and interference fit (space between rotor and stator); and determining operation parameters for drilling performance and reliability.

Above, the workflow can use a motor engine of a framework to generate one or more of a motor power curve and a fatigue life curve. As indicated, various actions can facilitate output of a cost-effective motor for a job while the last listed action can provide for determining operation parameters for drilling performance and reliability.

Figure 9:
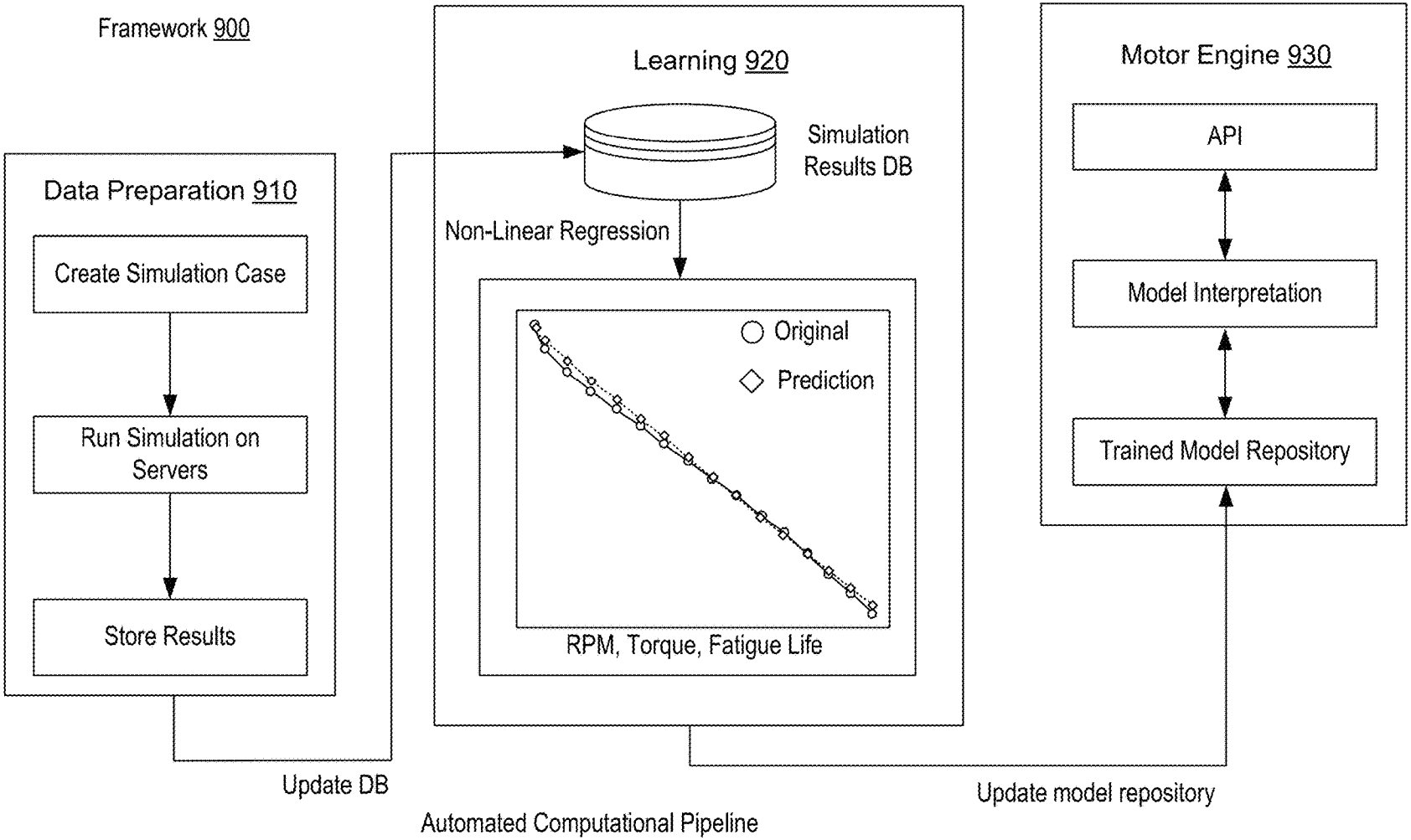
FIG. 9 illustrates an example of a framework.

FIG. 9 shows an example of a framework 900 for generating a motor engine 930 as a useable component for purposes of motor optimization for a job such as a directional drilling job. The framework 900 includes a data preparation component 910 for creating simulation cases, running simulations and storing results, a machine learning component 920 for performing machine learning based at least in part on the results of the data preparation component 910 and the motor engine 930 as including one or more application programming interfaces (APIs), a model interpretation feature and a trained model repository, for example, as provided by the machine learning component 920 as a model can be trained via machine learning.

As an example, the framework 900 may be an ongoing framework that is instantiated in the cloud or other computing system. For example, the framework 900 may be persisted using computational resources such as, for example, provisioned computational resources of a cloud platform. As an example, resources may be provisioned via allocation and de-allocation in a flexible and on-demand manner to meet demands of the framework 900. As an example, the framework 900 may operate responsive to receipt of data such that machine learning can be on-demand and output one or more trained modeled (e.g., new, updated, revised, tailored, etc.).

As shown in FIG. 9, the learning may occur at least in part via a non-linear regression with respect to one or more parameters such as, for example, RPM, torque, fatigue life, etc. Non-linear regression is a form of regression analysis in which data may be modeled by a function where the function is a non-linear combination of model parameters and depends on one or more independent variables. As an example, a non-linear regression technique can be iterative, for example, data can be fitted by successive approximations, which may be, for example, terminated once one or more criteria are met. An example of a non-linear regression technique is non-linear least squares (NLLS), which is used to fit a set of m observations with a model that is non-linear in n unknown parameters (m n). Some examples of NLLS are the Probit Regression, Threshold Regression, Smooth Regression, Logistic Link Regression, and Box-Cox Transformed Regressors.

As mentioned, an output of the motor engine 930 may be a motor and its expected fatigue life for a job (e.g., drilling a section of a trajectory of a borehole). Such information may be utilized in building a drillstring and utilizing the drillstring to build a well that may include at least one deviated portion. As an example, the motor engine 930 may output parameters utilized in controlling a motor such that motor fatigue is balanced with progress (e.g., rate of penetration, etc.). As an example, the motor engine 930 may output one or more instructions that can instruct one or more pieces of field equipment with respect to drilling in a geologic environment.

As mentioned, a workflow can perform a motor job optimization that selects and/or designs an effective motor for a job and that provides the fatigue life of the motor and/or provides operation parameter guidance for drilling performance and reliability. As mentioned with respect to FIG. 9, such information may be output via a motor engine as a framework component that utilized one or more trained models that are trained via machine learning based at least in part on simulation results from a simulator of motor operation.

Figure 10:
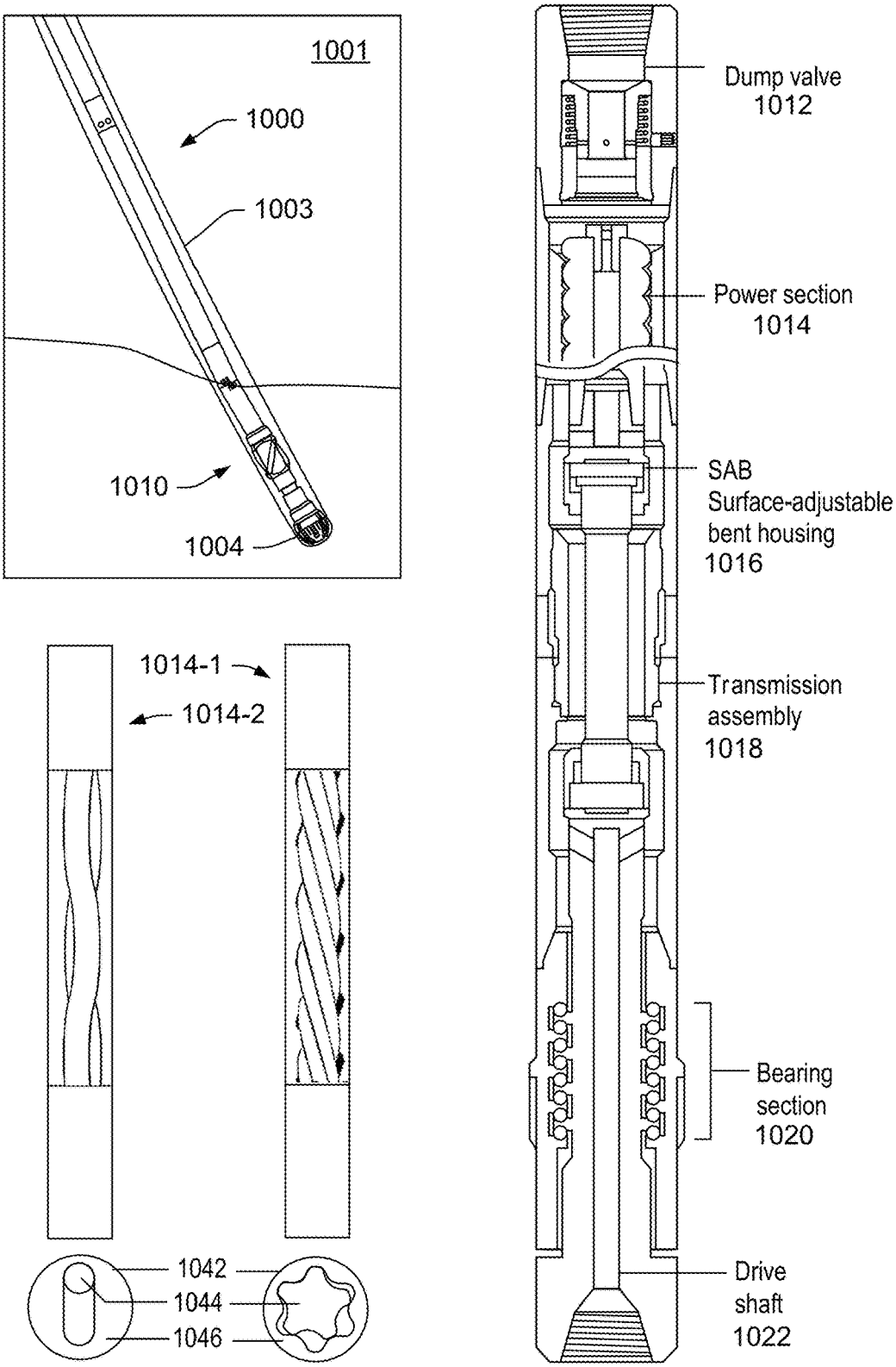
FIG. 10 illustrates examples of drilling equipment.

FIG. 10 shows an example of a drilling assembly 1000 in a geologic environment 1001 that includes a borehole 1003 where the drilling assembly 1000 (e.g., a drillstring) includes a bit 1004 and a motor section 1010 where the motor section 1010 can drive the bit 1004 (e.g., cause the bit 1004 to rotate and deepen the borehole 1003).

As shown, the motor section 1000 includes a dump valve 1012, a power section 1014, a surface-adjustable bent housing 1016, a transmission assembly 1018, a bearing section 1020 and a drive shaft 1022, which can be operatively coupled to a bit such as the bit 1004.

As to the power section 1014, two examples are illustrated as a power section 1014-1 and a power section 1014-2 each of which includes a housing 1042, a rotor 1044 and a stator 1046. The rotor 1044 and the stator 1046 can be characterized by a ratio. For example, the power section 1014-1 can be a 5:6 ratio and the power section 1014-2 can be a 1:2 ratio, which, as seen in cross-sectional views, can involve lobes (e.g., a rotor/stator lobe configuration). The motor section 1010 of FIG. 10 may be a POWERPAK family motor section (Schlumberger Limited, Houston, Tex.) or another type of motor section. The POWERPAK family of motor sections can include ratios of 1:2, 2:3, 3:4, 4:5, 5:6 and 7:8 with corresponding lobe configurations.

A power section can convert hydraulic energy from drilling fluid into mechanical power to turn a bit. For example, consider the reverse application of the Moineau pump principle. During operation, drilling fluid can be pumped into a power section at a pressure that causes the rotor to rotate within the stator where the rotational force is transmitted through a transmission shaft and drive shaft to a bit.

A motor section may be manufactured in part of corrosion-resistant stainless steel where a thin layer of chrome plating may be present to reduce friction and abrasion. As an example, tungsten carbide may be utilized to coat a rotor, for example, to reduce abrasion wear and corrosion damage. As to a stator, it can be formed of a steel tube, which may be a housing (see, e.g., the housing 1042) with an elastomeric material that lines the bore of the steel tube to define a stator. An elastomeric material may be referred to as a liner or, when assembled with the tube or housing, may be referred to as a stator. As an example, an elastomeric material may be molded into the bore of a tube. An elastomeric material can be formulated to resist abrasion and hydrocarbon induced deterioration. Various types of elastomeric materials may be utilized in a power section and some may be proprietary. Properties of an elastomeric material can be tailored for particular types of operations, which may consider factors such as temperature, speed, rotor type, type of drilling fluid, etc. Rotors and stators can be characterized by helical profiles, for example, by spirals and/or lobes. A rotor can have one less fewer spiral or lobe than a stator (see, e.g., the cross-sectional views in FIG. 10).

During operation, the rotor and stator can form a continuous seal at their contact points along a straight line, which produces a number of independent cavities. As fluid is forced through these progressive cavities, it causes the rotor to rotate inside the stator. The movement of the rotor inside the stator is referred to as nutation. For each nutation cycle, the rotor rotates by a distance of one lobe width. The rotor nutates each lobe in the stator to complete one revolution of the bit box. For example, a motor section with a 7:8 rotor/stator lobe configuration and a speed of 100 RPM at the bit box will have a nutation speed of 700 cycles per minute. Generally, torque output increases with the number of lobes, which corresponds to a slower speed. Torque also depends on the number of stages where a stage is a complete spiral of a stator helix. Power is defined as speed times torque; however, a greater number of lobes in a motor does not necessarily mean that the motor produces more power. Motors with more lobes tend to be less efficient because the seal area between the rotor and the stator increases with the number of lobes.

The difference between the size of a rotor mean diameter (e.g., valley to lobe peak measurement) and the stator minor diameter (lobe peak to lobe peak) is defined as the rotor/stator interference fit. Various motors are assembled with a rotor sized to be larger than a stator internal bore under planned downhole conditions, which can produce a strong positive interference seal that is referred to as a positive fit. Where higher downhole temperatures are expected, a positive fit can be reduced during motor assembly to allow for swelling of an elastomeric material that forms the stator (e.g., stator liner). Mud weight and vertical depth can be considered as they can influence the hydrostatic pressure on the stator liner. A computational framework such as, for example, the POWERFIT framework (Schlumberger Limited, Houston, Tex.), may be utilized to calculate a desired interference fit.

As to some examples of elastomeric Materials, consider nitrile rubber, which tends to be rated to approximately 138 C (280 F), and highly saturated nitrile, which may be formulated to resist chemical attack and be rated to approximately 177 C (350 F).

The spiral stage length of a stator is defined as the axial length for one lobe in the stator to rotate 360 degrees along its helical path around the body of the stator. The stage length of a rotor differs from that of a stator as a rotor has a shorter stage length than its corresponding stator. More stages can increase the number of fluid cavities in a power section, which can result in a greater total pressure drop. Under the same differential pressure conditions, the power section with more stages tends to maintain speed better as there tends to be less pressure drop per stage and hence less leakage.

Drilling fluid temperature, which may be referred to as mud temperature or mud fluid temperature, can be a factor in determining an amount of interference in assembling a stator and a rotor of a power section. As to interference, greater interference can result in a stator experiencing higher shearing stresses, which can cause fatigue damage. Fatigue can lead to premature chunking failure of a stator liner. As an example, chlorides or other such halides may cause damage to a power section. For example, such halides may damage a rotor through corrosion where a rough edged rotor can cut into a stator liner (e.g., cutting the top off an elastomeric liner). Such cuts can reduce effectiveness of a rotor/stator seal and may cause a motor to stall (e.g., chunking the stator) at a low differential pressure. For oil-based mud (OBM) with supersaturated water phases and for salt muds, a coated rotor can be beneficial.

As to differential pressure, it is defined as the difference between the on-bottom and off-bottom drilling pressure, which is generated by the rotor/stator section (power section) of a motor. As mentioned, for a larger pressure difference, there tends to be higher torque output and lower shaft speed. A motor that is run with differential pressures greater than recommended can be more prone to premature chunking. Such chunking may follow a spiral path or be uniform through the stator liner. A life of a power section can depend on factors that can lead to chunking (e.g., damage to a stator), which may depend on characteristics of a rotor (e.g., surface characteristics, etc.).

As to trajectory of a wellbore to be drilled, it can be defined in part by one or more dogleg seventies (DLSs). Rotating a motor in high DLS interval of a well can increase risk of damage to a stator. For example, the geometry of a wellbore can cause a motor section to bend and flex. A power section stator can be relatively more flexible that other parts of a motor. Where the stator housing bends, the elastomeric liner can be biased or pushed upon by the housing, which can result in force being applied by the elastomeric liner to the rotor. Such force can lead to excessive compression on the stator lobes and cause chunking.

A motor can have a power curve. A test can be performed using a dynamo meter in a laboratory, for example, using water at room temperature to determine a relationship between input, which is flow rate and differential pressure, to power output, in the form of RPM and torque. Such information can be available in a motor handbook. However, what is actually happening downhole can be differ due to various factors. For example, due to effect of downhole pressure and temperature, output can be reduced (e.g., the motor power output). Such a reduction may lead one to conclude that a motor is not performing. In response, a driller may keep pushing such that the pressure becomes too high, which can damage elastomeric material due to stalling (e.g., damage a stator).

Figure 11:
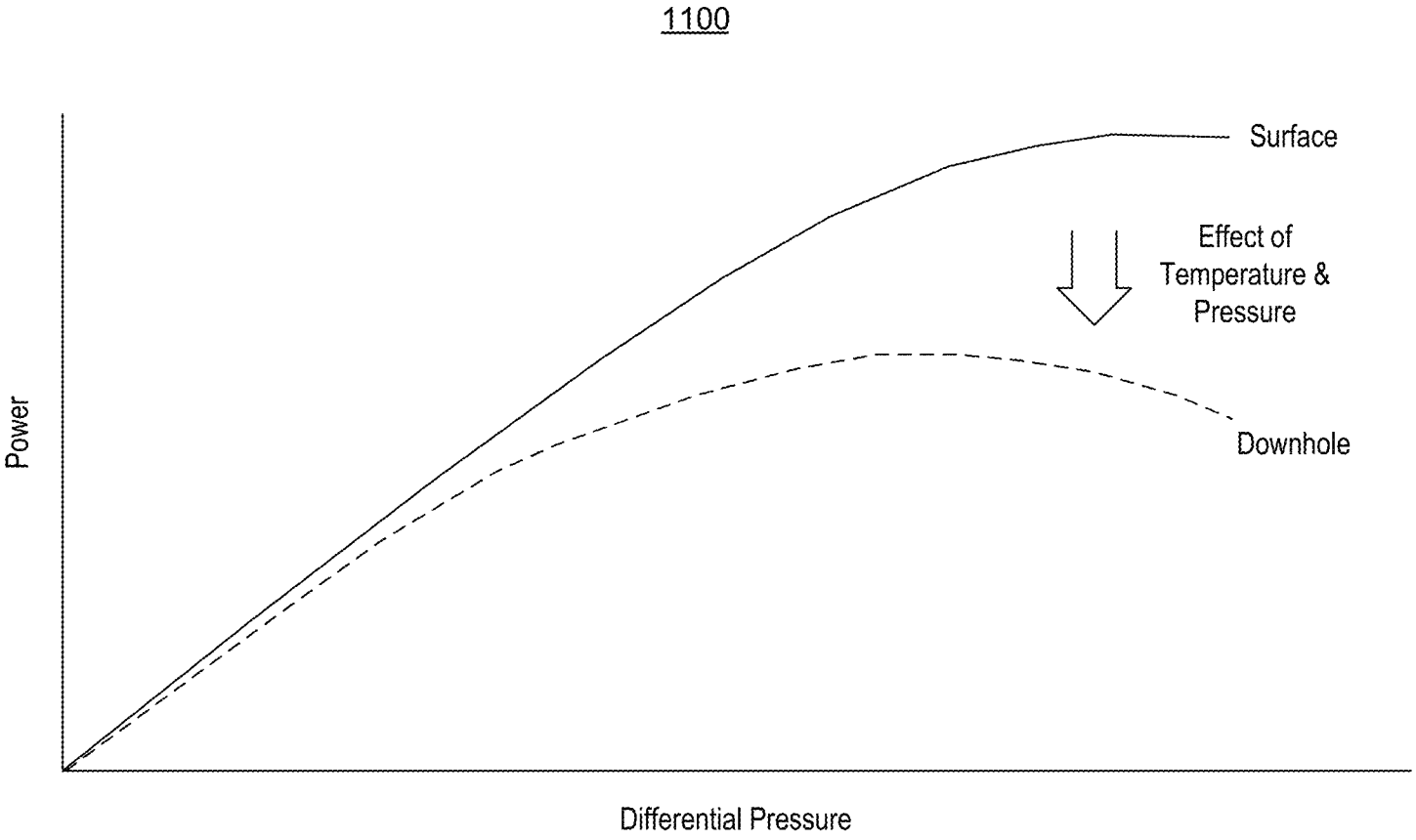
FIG. 11 illustrates an example of a plot.

FIG. 11 shows an example of a plot 1100 of power versus differential pressure for surface and downhole conditions. As shown, power can be reduced downhole due to effects of temperature and pressure and/or one or more other factors. The plot 1100 shows power versus differential pressure where differences between surface and downhole may increase with higher differential pressures.

Figure 12:
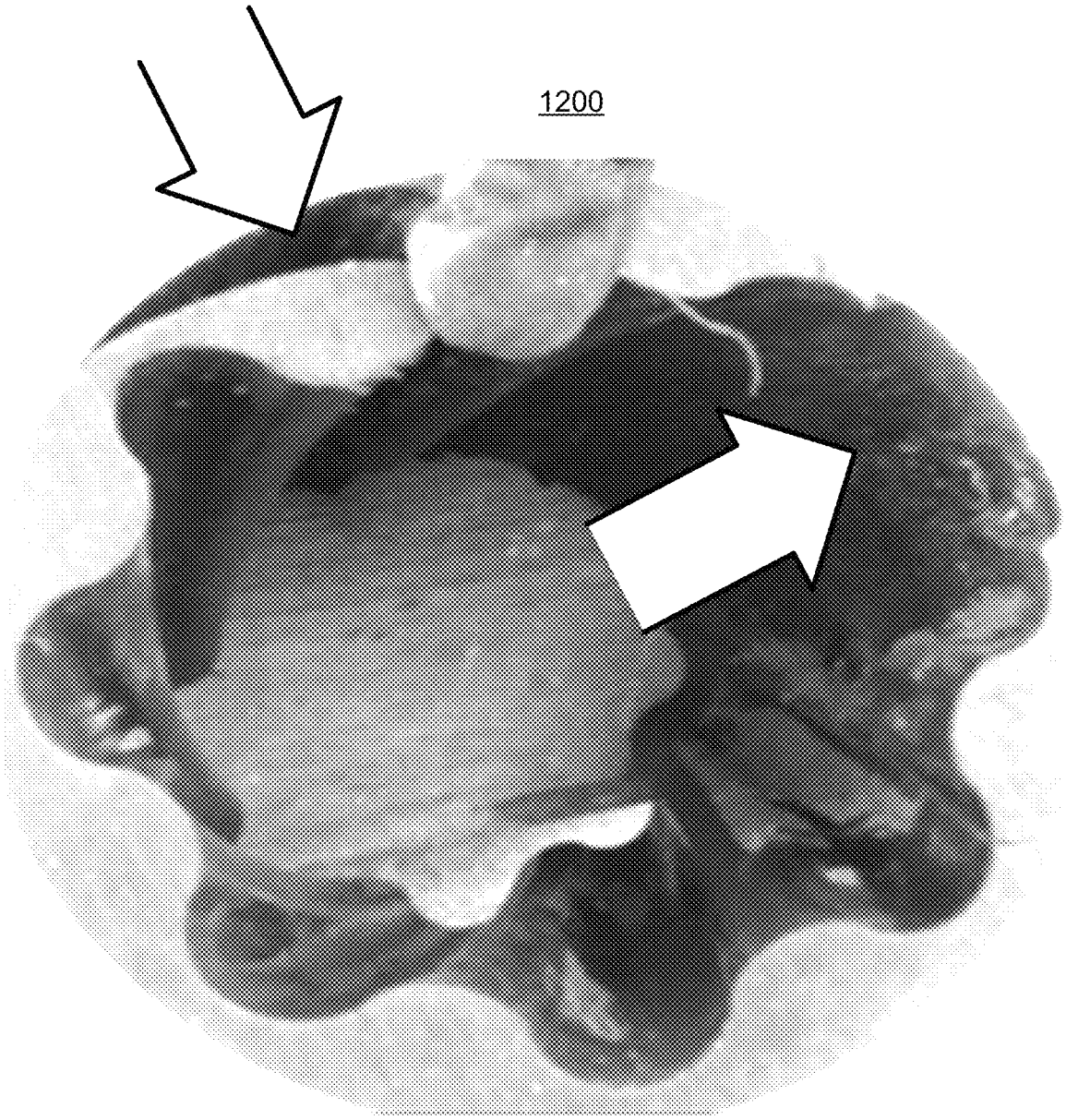
FIG. 12 illustrates an example of a drilling motor.

FIG. 12 shows an example of a photograph 1200 that illustrates fatigue failure as to an elastomeric material of a stator of a motor. Arrows indicate where separation from a tube or housing has occurred and where chunking has occurred.

To understand better about the behavior of motors in downhole conditions, a simulator can compute the downhole power curve as well as fatigue life. Such a simulator can model the geometry of the motor power section, and combine finite element analysis (FEA) and computational fluid dynamics (CFD) computation, together with lab tests for elastomeric materials.

As an example, LINUX clusters can run simulations to generate a simulation results database. Based on such a database, a machine learning model can be trained to predict simulation results. As mentioned, in an example, predicted results matched acceptably with simulation results (e.g., accuracy of about 98%). As an example, one or more application programming interfaces (APIs) can be built and implemented so that an application can easily query a motor engine (e.g., see the motor engine 930 of FIG. 9).

A LINUX cluster can be a connected array of LINUX computers or nodes that work together and can be viewed and managed as a single system. Nodes may be physical or virtual machines, and they may be separated geographically. Each node includes storage capacity, processing power and I/O (input/output) bandwidth. Compared to a single computer, a LINUX cluster can provide faster processing speed. A LINUX cluster may be dedicated to a specific function such as running numerical model-based simulations (e.g., FEA, CFD, etc.) that are based on equations that model geometries and physical phenomena. While a LINUX cluster can provide processing speed that is faster than a single computer, the underlying numerical model-based motor simulation can still demand a substantial amount of time, which can make such an approach unsuitable for various workflows (e.g., real time workflows, etc.). As mentioned, a workflow for design and/or building a drillstring with a motor can be expedited where motor selection can be expedited (e.g., via a trained machine model). Referring again to FIG. 9, the motor engine 930 can be utilized to expedite one or more types of workflows and/or enable one or more types of real time workflows.

As an example, a response from the motor engine may be fast, for example, one query can provide a response in less than one second (e.g., consider a response being generated to a query in an amount of time that may be of the order of milliseconds). As such, via one or more APIs, a call and response of a motor engine can be quite practical and can be implemented in one or more different systems and/or scenarios. As an example, such an approach can be extensible as if there is a new motor to be added or there is a demand to update simulation results, a motor engine can be updated (see, e.g., the data preparation 910 and the learning 920 of FIG. 9, which can update the motor engine 930).

Figure 13:
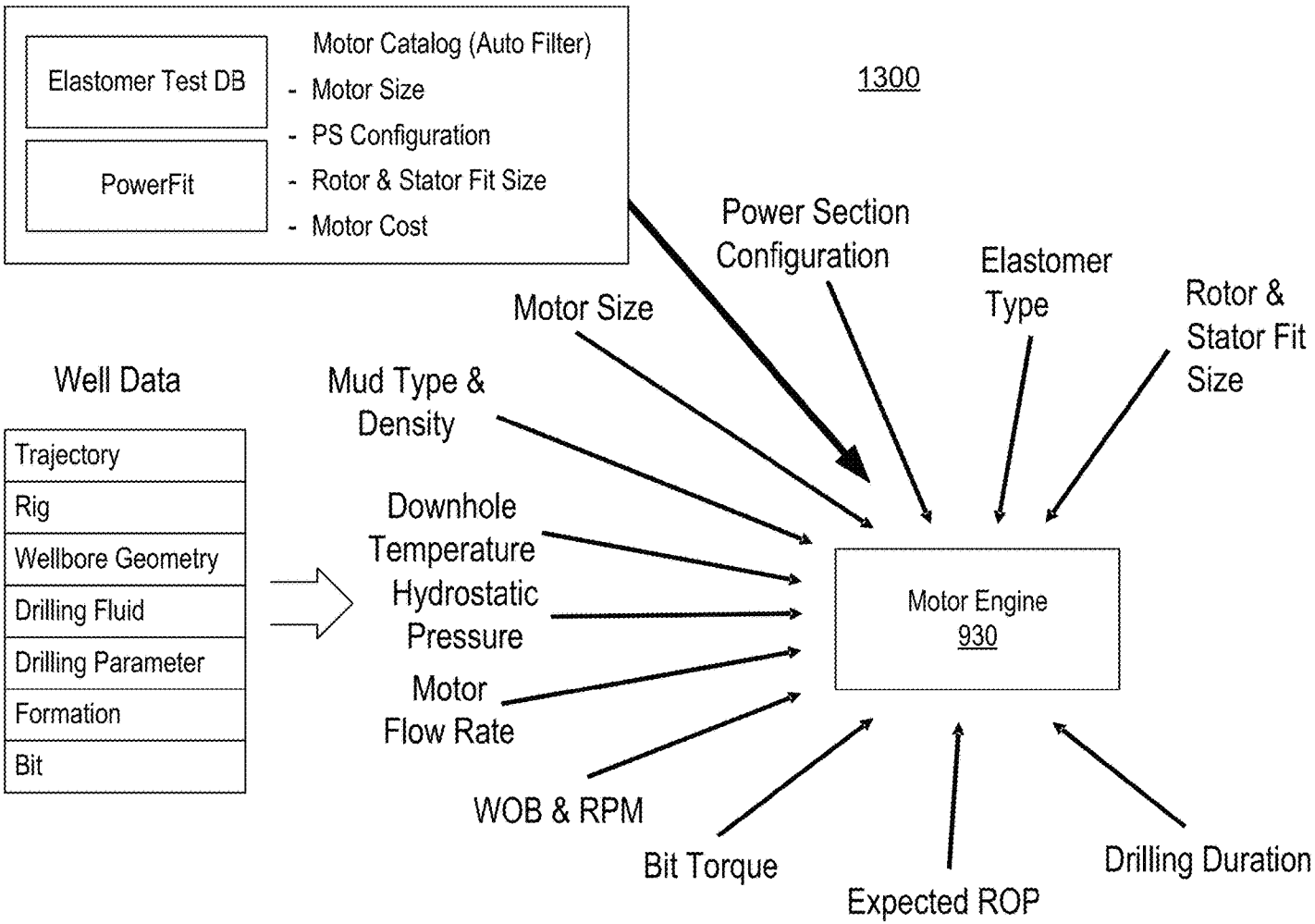
FIG. 13 illustrates an example of generating a computational motor engine component.

FIG. 13 shows an example of a schematic of a system 1300 that includes inputs that can be accounted for by the motor engine (see, e.g., the motor engine 930). As shown, information may be input from various sources. As an example, one or more filters may be available to, for example, filter by borehole size, filter by inventory (e.g., business system), filter by offset well analysis, etc.

FIG. 14 shows an example of a graphical user interface (GUI) 1400. As mentioned, compatibility between mud (e.g., drilling fluid) and an elastomer can be a factor for a stator liner. As such, a method can include building an elastomer mud test database for elastomer recommendation and power fit for fit size setup. In the example of FIG. 14, the GUI 1400 shows an order or elastomer recommendations with respect to scores. The GUI 1400 also shows various motor dimensions and rotor and stator fits. Further, the GUI 1400 shows temperature information that can be taken into account.

Figure 15:
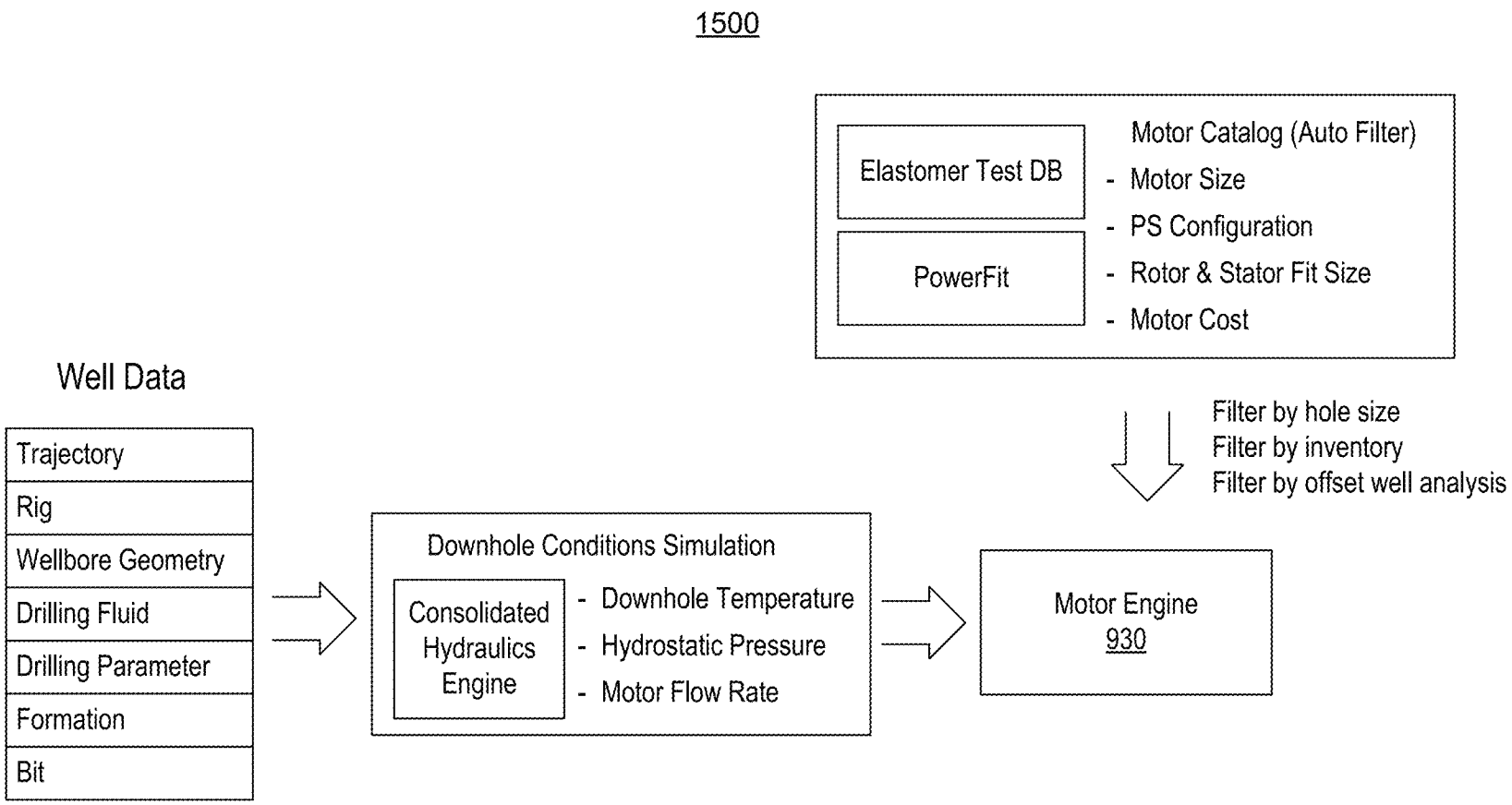
FIG. 15 illustrates an example of generating a computational motor engine component.

FIG. 15 shows an example of an implementation of a system 1500 that can be utilized for generating a motor engine (see, e.g., the motor engine 930). The system 1500 can include a motor catalog (e.g., a digital catalog) and a downhole conditions simulator that can perform downhole condition simulations. Such simulations may include using a consolidated hydraulics engine as a component that can account for hydraulic phenomena. As shown, the downhole conditions simulations can provide for downhole temperature, hydrostatic pressure and motor flow rate information.

Figure 16:
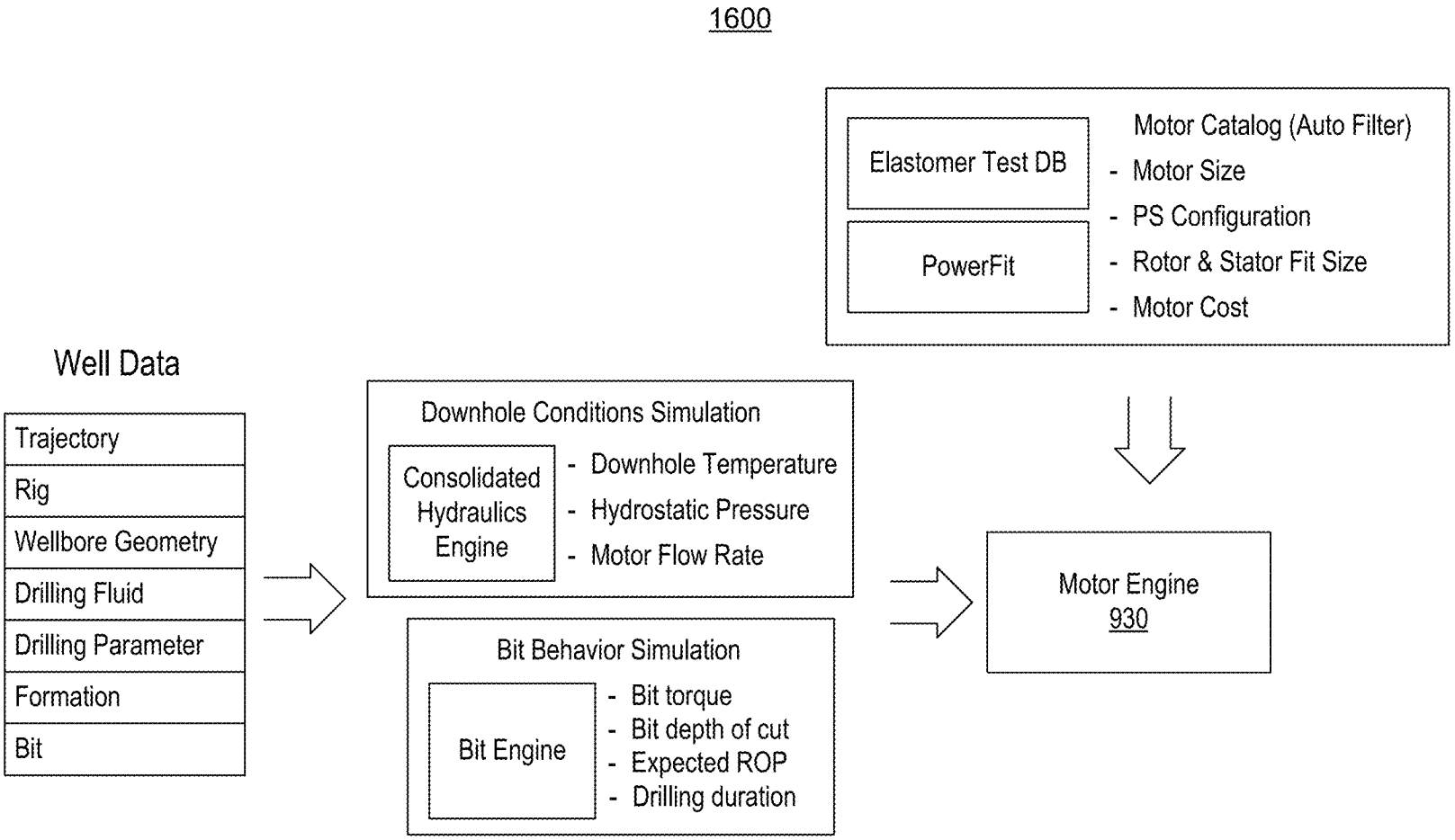
FIG. 16 illustrates an example of generating a computational motor engine component.

FIG. 16 shows another example of an implementation of a system 1600 that can be utilized for generating a motor engine (see, e.g., the motor engine 930). In the example of FIG. 16, a bit behavior simulator can be implemented, for example, using a bit engine that can provide for bit torque, bit depth of cut, expected rate of penetration (ROP), and drilling duration information.

Figure 17:
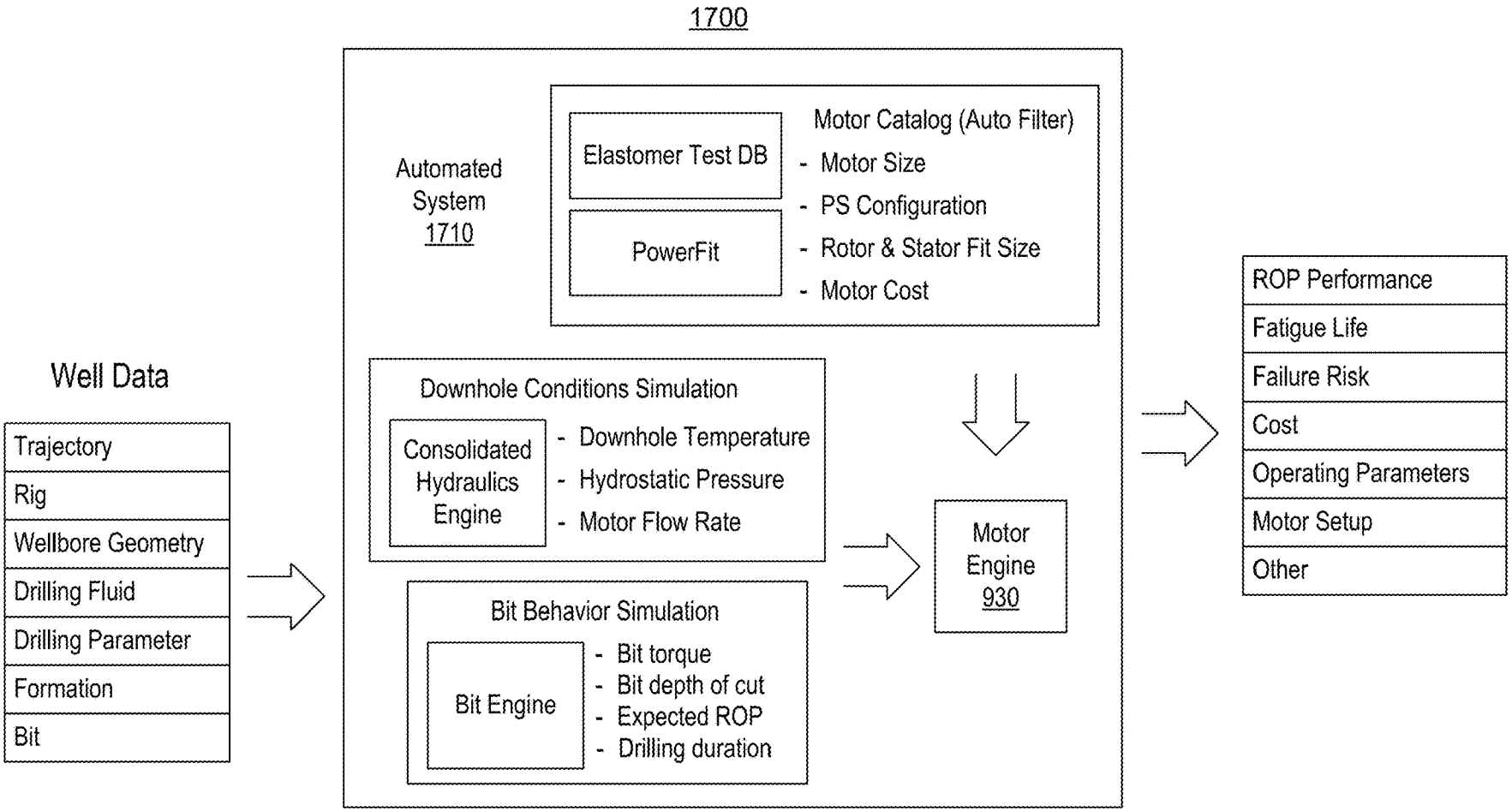
FIG. 17 illustrates an example of generating a computational motor engine component.

FIG. 17 shows another example of an implementation of a system 1700 that can be utilized for generating a motor engine (see, e.g., the motor engine 930). As shown, the system 1700 can include an automated system 1710 that can be utilized to generate and/or update the motor engine 930. As an example, the automated system 1710 may be a system of operatively coupled frameworks, which can include, for example, a database (e.g., a motor catalog), a downhole conditions simulator and a bit behavior simulator. The automated system 1710 can be driven responsive to receipt of various types of data such as, for example, well data, which may include one or more of trajectory, rig, wellbore geometry, drilling fluid, drilling parameter, formation and bit information. As mentioned, where a motor catalog is updated, revised, etc., a motor engine may be updated, revised, etc. For example, where the motor catalog changes, the automated system 1710 may automatically change the motor engine 930.

Figure 18:
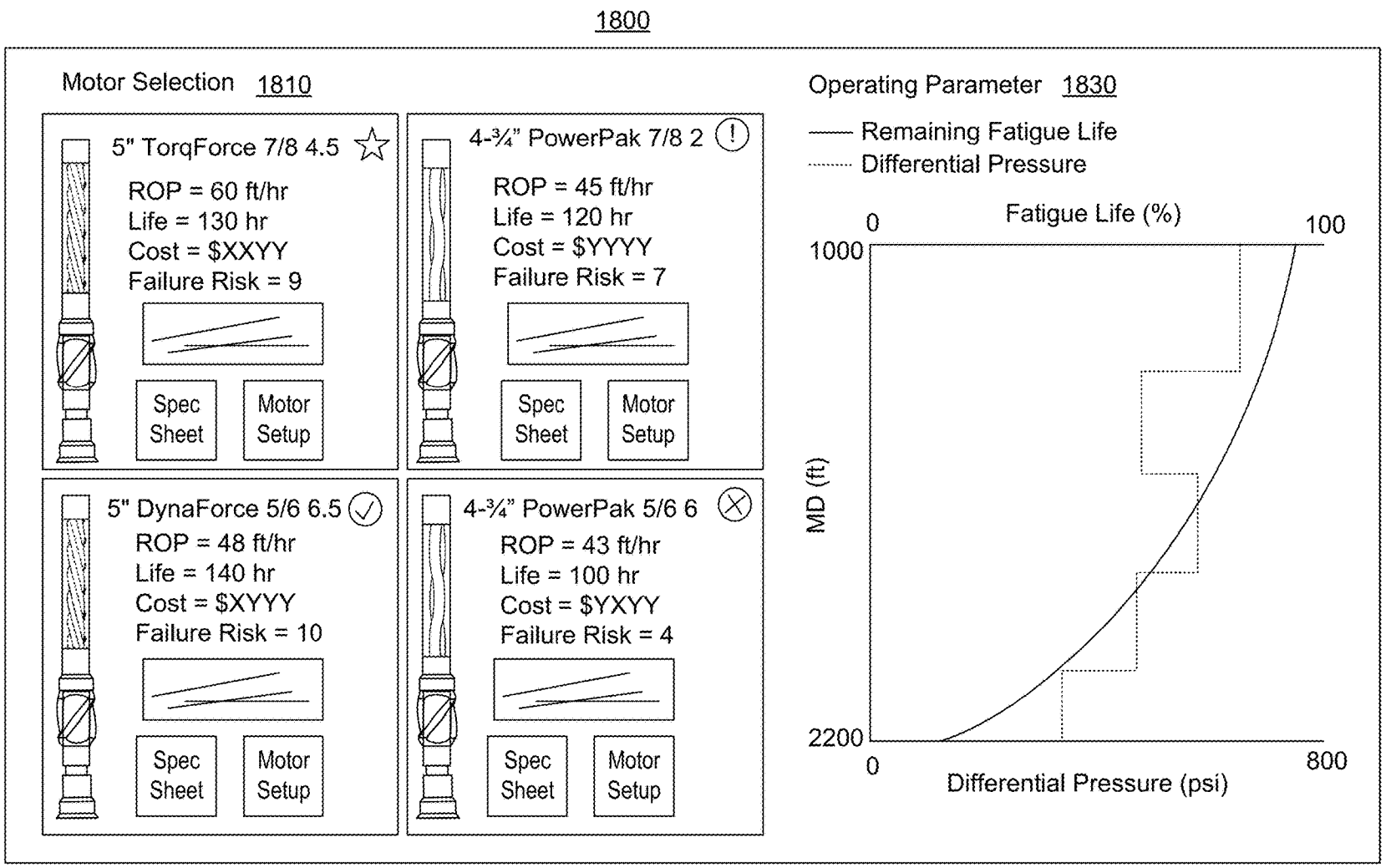
FIG. 18 illustrates an example of a graphical user interface.

FIG. 18 shows an example of a graphical user interface (GUI) 1800 for rendering information to a display responsive to a call to the motor engine. As shown, one or more motors specifications may be returned and rendered for analysis, etc., and selection. As shown, coding, symbols, etc., may be utilized to facilitate selection of a motor.

The GUI 1800 includes an example GUI 1810 and an example GUI 1830. The GUI 1810 shows various motors for which information can be rendered responsive to operation of a motor engine (see, e.g., the motor engine 930). In such an example, information for the various different motors can be rendered to make comparisons and, for example, a selection of a desirable motor. The motors illustrated include POWERPAK, TORQFORCE and DYNAFORCE examples, noting that one or more other examples may be included. The GUI 1810 shows information such as ROP, life in hours, cost, failure risk (e.g., from 0 to 10) where a higher value is better (less failure risk). The graphics of the motors may include specifics as to rotor/stator configurations, noting that the examples illustrated are for demonstrating such graphics and not necessarily features of the brands of motors shown. The GUI 1810 can allow a user to readily assess a number of motors for a job and to select one of the motors, for example, via a mouse click, a touch, etc., which may initiate a process to build a BHA, etc.

As to the GUI 1830, it shows a plot of remaining fatigue life and differential pressure with respect to measured depth (MD) of a trajectory. As shown, the remaining fatigue life decreases with respect to MD and the differential pressure tends to decrease with respect to MD.

The GUI 1800 can provide a user with a rich set of information as to motors where one of the motors may be selected for a particular job. Such a GUI can be operatively coupled to a motor engine (see, e.g., the motor engine 930). For example, consider an application that includes instructions for issuing one or more API calls to a motor engine where the motor engine returns information as to one or more motors, where such information can be analyzed, rendered, etc.

Figure 19:
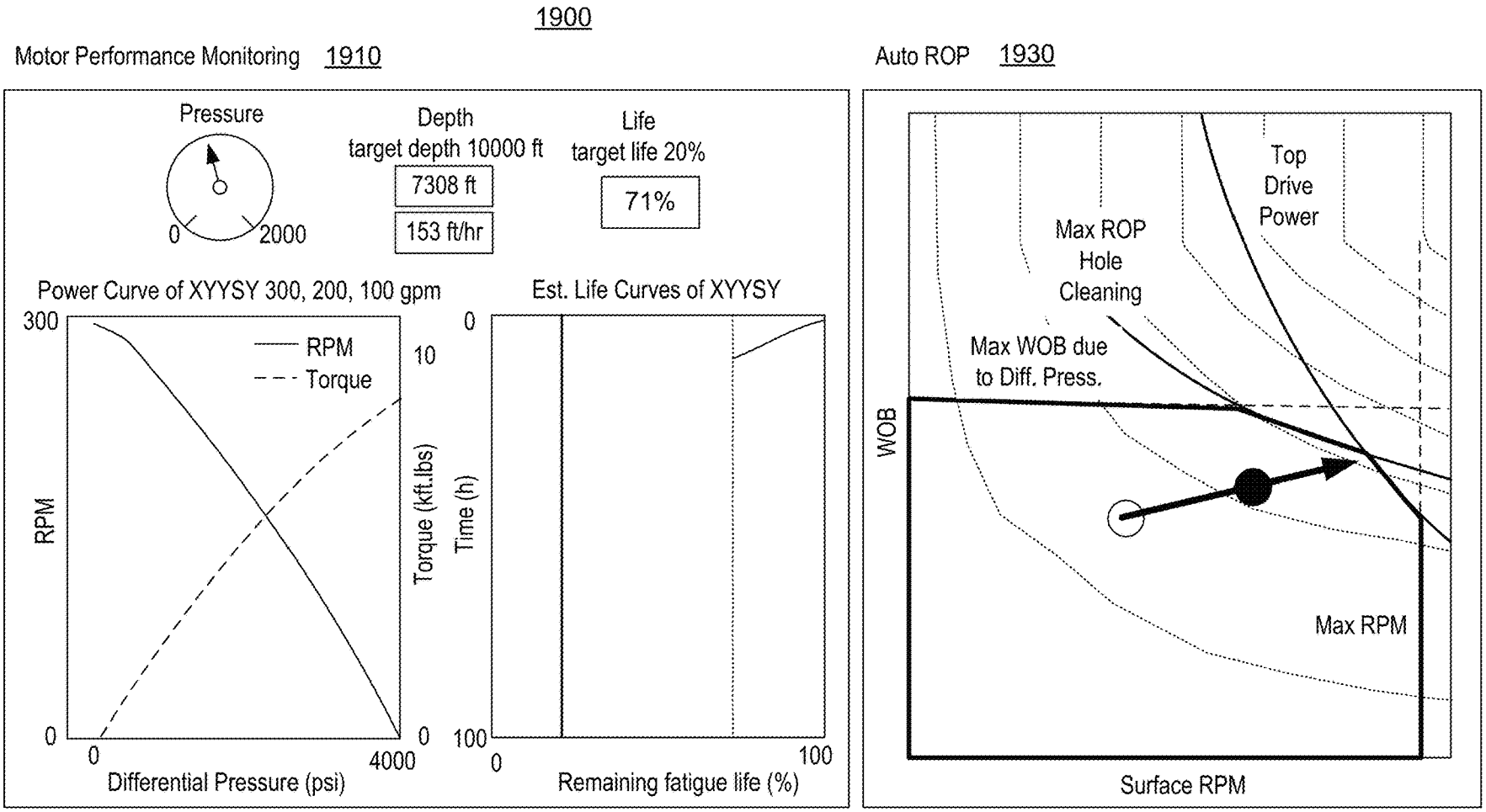
FIG. 19 illustrates an example of graphical user interfaces.

FIG. 19 shows an example of a GUI 1900 with example GUIs 1910 and 1930 for operations. For example, a dashboard can be rendered to a display with performance monitoring and residual life monitoring. At the beginning, a driller may use high differential pressure to push the performance of a motor, but as long as the consumed fatigue life reaches a limit, information can be rendered to assure care is taken in operations to make sure the motor can finish in one run. In such an example, there can be an improved shoe-to-shoe ROP.

As an example, an "Auto ROP" GUI for real time drilling parameter guidance may be rendered to a display. In such an example, using more accurate downhole power curves may help to provide more accurate ROP prediction, as well as the operating limits for drilling parameters.

As an example, the GUI 1910 may be run in real time during a drilling operation. In such an example, a plot of remaining fatigue life may be rendered with respect to time and/or depth. In the example of FIG. 19, a limit is set at 20%, illustrated by a vertical line. As time passes, the dotted vertical line can move to the left toward the limit where the past estimates are shown as a curve such that a driller may understand what types of actions resulted in decreases or increases in the rate at which remaining fatigue life diminished. The GUI 1910 also shows depth and rate of penetration (ROP) along with differential pressure and a plot of RPM and torque versus differential pressure where RPM decreases and torque increases with differential pressure.

The GUI 1930 may be run in real time where sensor data can be utilized to plot a point on a plot of weight on bit (WOB) versus surface RPM. As shown, the plot of the GUI 1930 includes contours along with identified parameter values such as top drive power, maximum ROP hole cleaning, maximum WOB due to differential pressure and maximum RPM. An intersection of tope drive power and maximum ROP hole cleaning is shown where a box can indicate an operational regime for drilling operations.

As an example, a method can include design or selection of a bit by running an IDEAS platform dynamics simulation (Schlumberger Limited, Houston, Tex.), which allows for comparing options by looking at the ROP performance versus shock and vibration. For a motor BHA, the simulation results for bit will be affected by the behavior of the motor. By using more accurate downhole power curve from motor modeling, a workflow may output better bit/motor compatibility for best performance and stability.

The IDEAS integrated dynamic design and analysis platform provides 4D, time-based simulations that capture a drillstring and wellbore geometry for modeling of cutting interface designs for drilling rock and milling metal applications. The IDEAS dynamic modeling platform includes a suite of solid mechanics and programs that enable modeling bit-to-rock and mill-to-metal interactions in a virtual environment to customize material design in real time. The IDEAS platform can use theoretical calculations, numerical packages (e.g., finite element, etc.), in-house drill rig tests, full-scale rig tests, and field tests with MWD or downhole drilling dynamics sensors.

Figure 20:
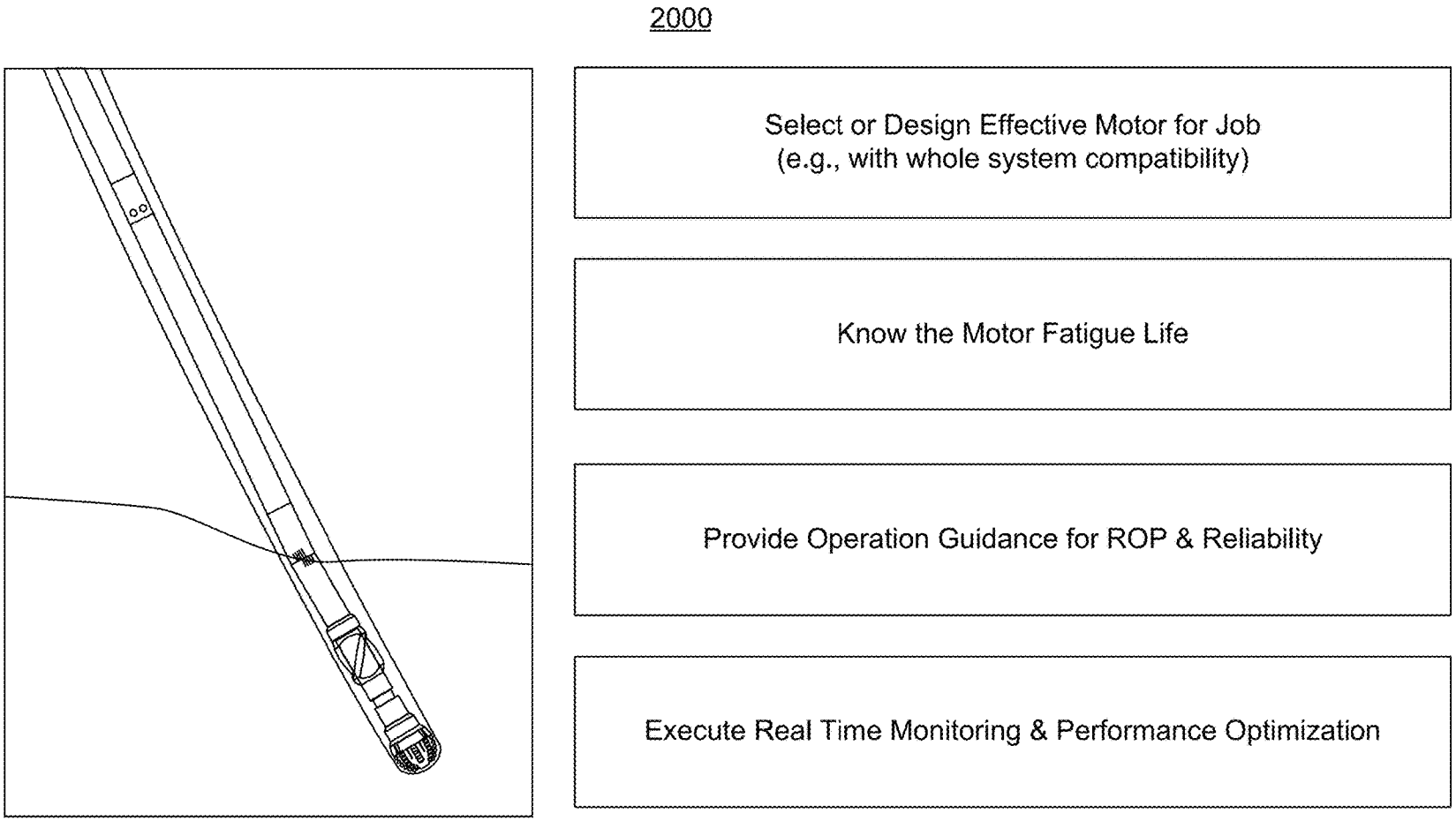
FIG. 20 illustrates some examples of capabilities of a computational motor engine component.

FIG. 20 shows an example of features 2000 of a framework with respect to a drilling operation. As mentioned, a motor engine can be a computational component that is hosted by one or more computational resources and that may be instantiated on demand or otherwise available. As an example, a motor engine can include a specification as to how calls are made and information returned in response. For example, one or more APIs may be provided that facilitate interoperability such that one or more motor engines may be available for drilling operations in one or more locations.

Figure 21:
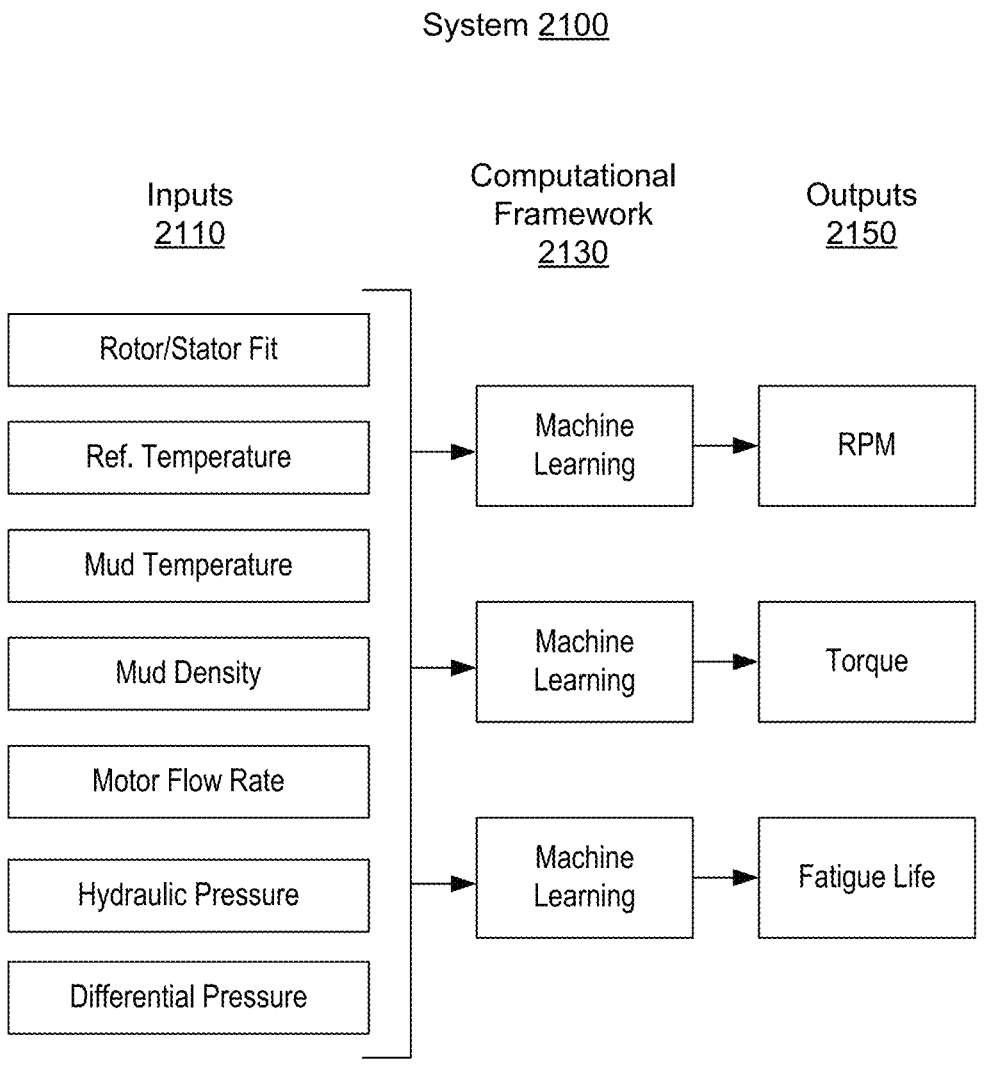
FIG. 21 illustrates an example of a system.

FIG. 21 shows an example of a system 2100 that includes inputs 2110 that can be received via at least one interface of a computational framework 2130 that can provide outputs 2150 via at least one interface. As shown, the inputs 2110 can include information as to rotor/stator fit, temperature (e.g., a reference temperature), drilling fluid (e.g., temperature, density, etc.), motor flow rate, hydraulic pressure and differential pressure. The computational framework 2130 can include a plurality of machine learning components, which can be trained to provide trained machine models. In the example of FIG. 21, the outputs 2150 include RPM, torque and fatigue life (e.g., remaining fatigue life) of a motor as operational in an environment (e.g., according to information in the inputs 2110, etc.).

As an example, the computational framework 2130 can be accessible via one or more APIs. For example, consider an application that transmits an API call to an interface of the computational framework 2130 where the API call includes at least some of the inputs 2110. In such an example, one or more of the machine learning components of the computational framework 2130 can return, in response to the API call, one or more of the outputs 2150. As to an ongoing operation, various inputs may be specified once such as, for example, rotor/stator fit, and one or more inputs may be updated, optionally in real time, during the ongoing operation. For example, consider updates to changes in drilling fluid, hydraulic pressure, etc. As an example, an API call may specify an output or outputs. As an example, an application may request RPM, torque and/or fatigue life, depending on the particular reason for the request (e.g., consider an API call as a request). As mentioned, the computational framework 2130 can provide for more rapid responses when compared to a simulator that utilizes physics-based model equations for simulating behaviors and/or conditions of a motor or germane to motor operation.

As an example, the computational framework 2130 can be a cloud-based framework that operates using provisioned cloud-based resources. Such resources can be accessible via a network or networks (e.g., the Internet), for example, via a local web application, which may execute using equipment at a rig site where drilling operations are to be performed or being performed. Such an application can provide for rendering of one or more graphical user interfaces (GUIs) that can facilitate drilling operations (e.g., motor selection, motor performance monitoring, drilling, etc.).

FIG. 22 shows an example of a machine learning model 2210, an example of an activation function 2230 and an example of a method 2250. As shown, the machine learning model 2210 is an artificial neural network machine learning model (ANN model or ML model). In the example of FIG. 22, the ML model 2210 includes neurons organized in layers where the layers include an input layer, an output layer and intermediate hidden layers. The number of neurons in each layer is indicated with seven in the input layer, 64 in the first hidden layer, 16 in the second hidden layer, 8 in the third hidden layer and a single neuron in the output layer. The layers activate from left to right in the example of FIG. 22 such that activation of a neuron in the first hidden layer can call upon action by a neuron (or neurons) in the second hidden layer, etc. The output layer can be, for example, one of RPM, torque and fatigue life (e.g., remaining fatigue life). In the example of FIG. 21, the computational framework 2130 can include three instances of such a ML model. For example, each ML component in the computational framework 2130 can include an architecture as in the ML model 2210 of FIG. 22. The example inputs 2110 of FIG. 21 can correspond to the seven input neurons of the ML model 2210 of FIG. 22 and the single output neuron of the ML model 2210 of FIG. 22 can correspond to one of the outputs 2150 of the computational framework 2130 of FIG. 21.

As shown in the example of FIG. 22, the activation function 2230 is a rectified linear unit (ReLU) function. The variable "z" is an input to a neuron in a layer of an ANN model or a ML model. While a ReLU is mentioned as a basic type of ReLU, one or more variations of a ReLU may be utilized (e.g., "leaky", "noisy", parametric, etc.).

The computational framework 2130 may be implemented using a platform such as, for example, the SCI KIT platform (e.g., scikit-learn), which utilizes the PYTHON programming language. The method 2250 includes various actions that can operate on a dataset to train a ML model. As shown, a dataset can be split into training data and test data where test data can provide for evaluation. The method 2250 also shows parameters, cross-validation of parameters and best parameters, which can be provided for model training.

As an example, a ML model can be trained using a multi-layer perceptron approach (MLP approach), which can be performed in a supervised manner. Given a set of features and a target, an MLP approach can learn a non-linear function approximator for either classification or regression. As an example, a ML model can be trained using ensemble methods. Ensemble methods aim to combine the predictions of several base estimators built with a given learning algorithm to improve generalizability and/or robustness over a single estimator. Examples of ensemble methods include averaging and boosting. As an example, one or more ensemble methods may be utilized with a base estimator, which may be, for example, in a range from approximately 2 to approximately 50. In an example, a trained ML model utilized a base estimator of 15. A base estimator may be, for example, a tree structure (e.g., a decision tree type of structure). As an example, a base classifier can be a forest (e.g., a random forest) with a number of base estimators.

The computational framework 2130 may utilize the Adam algorithm (adaptive moment estimation) as to weight determinations, as described, for example, in an article by Kingma et al., entitled "Adam: A Method for Stochastic Optimization", arXiv:1412.6980, [v9] Mon, 30 Jan. 2017 01:27:54 UTC (490 KB), which is incorporated by reference herein. Adam is an algorithm for first-order gradient-based optimization of stochastic objective functions, based on adaptive estimates of lower-order moments, that is invariant to diagonal rescaling of the gradients and tends to be suited for problems that are large in terms of data and/or parameters. Adam is suitable for non-stationary objectives and problems with very noisy and/or sparse gradients. In Adam, hyper-parameters have intuitive interpretations and often demand little tuning. A variant of Adam is AdaMax, which is based on the infinity norm.

As an example, an MLP approach can train a ML model using an algorithm such as the Adam algorithm. For example, an MLP approach can update parameters using a gradient of the loss function with respect to a parameter that demands adaptation (e.g., according to one or more criteria) using an algorithm such as the Adam algorithm, noting that other types of algorithms include stochastic gradient descent (SGD), L-BFGS, etc. As to updating of parameters, consider a formulation such as the following SGD formulation:

$$w \leftarrow w$$
$$\eta\left(\alpha\frac{\partial R(w)}{\partial w} + \frac{\partial \text{Loss}}{\partial w}\right)$$

where w is a parameter, where R is a regularization term (e.g., penalty) that penalizes model complexity, where a is a non-negative hyperparameter of the SGD, where $\eta$ is the learning rate that controls the step-size in the parameter space search and where Loss is the function used for the ML model (e.g., ANN model) for measuring (mis)fit.

The Adam algorithm can automatically adjust the amount to update parameters based on adaptive estimates of lower-order moments. In the Adam algorithm, running averages of both the gradients and the second moments of the gradients can be utilized.

Cross-validation can be implemented for assessing how the results of a statistical analysis will generalize to an independent data set. It can be implemented to estimate how accurately a predictive model will perform in practice. In a prediction problem, a model can be given a dataset of known data on which training is run (training dataset), and a dataset of unknown data (or first seen data) against which the model can be tested (e.g., test set). Cross-validation aims to test the model's ability to predict new data that was not used in estimating it, in order to flag problems like overfitting or selection bias and to give an insight on how the model will generalize to an independent dataset (e.g., an unknown dataset, for instance from a real problem).

One round of cross-validation involves partitioning a sample of data into complementary subsets, performing the analysis on one subset (called the training set), and validating the analysis on the other subset (called the validation set or testing set). To reduce variability, multiple rounds of cross-validation can be performed using different partitions, and the validation results may be combined (e.g. averaged, etc.) over the rounds to give an estimate of the model's predictive performance. Cross-validation can combine measures of fitness in prediction to derive a more accurate estimate of model prediction performance.

The computational framework 2130 of FIG. 21 can utilize one or more trained ML models, which may be structured, trained, etc., as explained with respect to FIG. 22. As an example, the computational framework 2130 of FIG. 21 can be operatively coupled to at least one interface for inputs and outputs for training and/or be operatively coupled to at least one interface for one or more of the inputs 2110 for generating one or more of the outputs 2150. As an example, an API call can include values for the inputs 2110 and return one or more values that correspond to one or more of the outputs 2150.

As mentioned, various simulations can use finite-element-analysis (FEA) and computational-fluid-dynamics (CFD) to model complex dynamic downhole conditions and behaviors of drilling tools. However, a complex simulation may take a few hours to run, which limits usage (e.g., limited to well planning jobs where a sufficient amount of time is available). A computational framework as in FIG. 21 can be an alternative that can provide for real-time monitoring applications, where computation speeds less than a few minutes are desirable. For example, the computational framework 2130 can respond to inputs 2110 to provide outputs 2150 in less than one minute and, for example, in less than about 10 seconds. In an example, a response was achieved in less than one second with acceptable accuracy in comparison to numerical FEA/CFD model based simulation results (see, e.g., FIG. 9).

As an example, a framework may include features for improving the performance of drilling simulations, which can include smart depth selection logic for BHA tendency calculation and/or a reduced order model using machine learning for motor optimization modeling.

The success of well construction can depend on good planning, comprehensive risk assessment and preparations for contingency. During a planning phase, engineers can evaluate various design scenarios to understand the potential outcome and risk and optimize a drilling program for the best performance. Over the years, the capability to perform engineering analysis has been improved with the advancement of modeling technologies. Many drilling processes and physical phenomena have been understood and successfully modeled using finite-element-analysis (FEA) and computational-fluid-dynamics (CFD).

Modeling and simulating the dynamic drilling process can involve many parameters and substantial computing resources. As mentioned, a simulation can take hours to be performed. If an engineer wants to simulate with various parameter sensitivities and scenarios then the amount of time can grow exponentially. At some point, this time demand becomes an issue during a planning phase in that engineers may not have enough time to perform various scenarios or evaluate effects of various parameters. The time factor for simulations can become a blockage to use the dynamic modeling for execution monitoring.

One or more smart methodologies may be implemented to improve the drilling simulation computation performance. For example, consider smart depth selection logic for BHA tendency calculation and reduced order model using machine learning for motor optimization modeling.

As to smart depth selection, an ability of a BHA to deliver tendency to drill a trajectory as per a specified dogleg severity (DLS) can be a concern. A BHA may be characterized, as a steering system, with respect to tendency (e.g., directional tendency, build tendency, walk tendency, dropping tendency, a tendency to drill straight ahead, a tendency to drift laterally, a tendency to stay on a current path, etc.). A BHA may have a natural tendency to maintain or return to a straight form (e.g., linear along a longitudinal axis of the BHA).

If during execution, a BHA is not capable to build/drop/turn as per the desired DLS of a section, then a drilling process may be stopped and the BHA pulled to surface (e.g., tripped out of hole or pulled out of hole (POOH)) for modification, replacement, etc. In some instances, even with a different BHA, a trajectory path may not reach the planned target. As such, modeling the expected BHA tendency is desirable during a planning phase.

Figure 23:
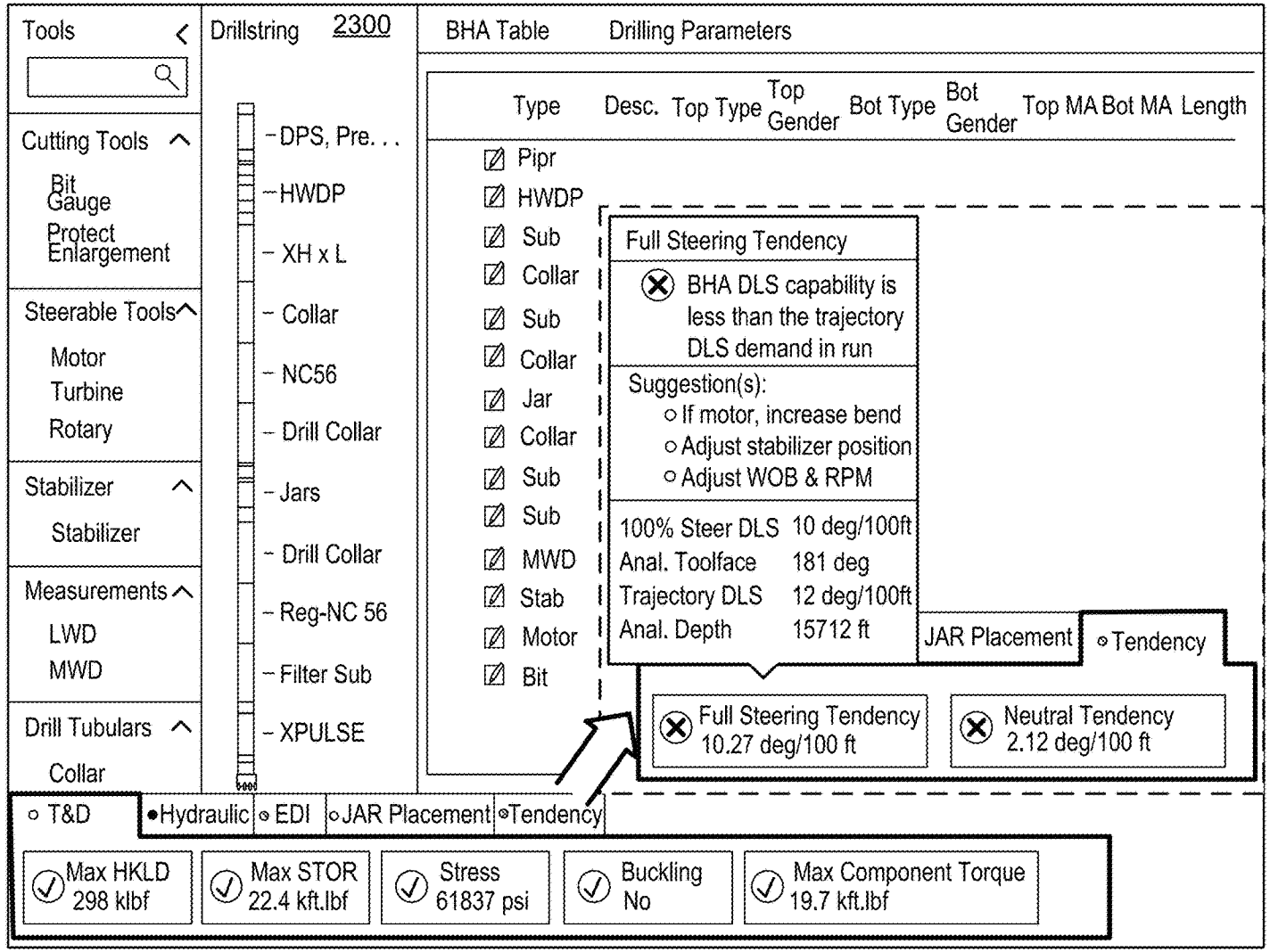
FIG. 23 illustrates an example of a graphical user interface.

FIG. 23 shows an example of a graphical user interface (GUI) 2300 that includes various types of information and tabs. For example, the GUI 2300 includes a torque and drag tab (T&D), a hydraulic tab, an estimated drilling interference (EDI) tab, a jar replacement tab, and a tendency tab. The GUI 2300 shows instances of two tabs being selected, the T&D tab and an overlay for the tendency tab. As to the overlay for the tendency tab, as shown, information concerning full steering tendency can be rendered to a display. Such information can indicate whether a BHA (see, e.g., graphic of a BHA) has a specified DLS capability. If not, the GUI 2300 may render one or more suggestions that can be taken such as, for example, increase bend (e.g., bendability) of a BHA, adjust stabilizer position (e.g., if adjustable), adjust WOB and/or RPM. As shown, various details can be rendered such as 100 percent steering DLS (e.g., 10 degrees per 100 ft), a toolface analysis (181 degrees), a trajectory DLS (e.g., 12 degrees per 100 ft), an analysis depth (e.g., 15721 ft). In the example of FIG. 23, the tendency tab can include indicators as to full steering tendency (e.g., 10.27 degrees per 100 ft) and/or neutral tendency (e.g., 2.12 degrees per 100 ft). Such information can alert a planner and/or a driller as to one or more issues and optionally one or more possible remedies to a tendency issue.

To predict the directional tendency of a BHA, a finite element method (FEM) based simulation system can be established to accurately calculate the actual BHA drilling behaviors. Such a FEM approach can be capable of modeling each drillstring component from the top drive to the drill bit, taking into account the drillstring contact and cutting structures (e.g., bit, reamer, etc.) interactions with a formation. A simulation can be depth-based, which simulates a drill ahead condition that can demand multiple iterations of tendency calculations where each single depth simulation demands about 30 seconds to 120 seconds of computation time. In well planning applications, engineers often want to evaluate the BHA steering ability in the depth range of entire drilling run, which means hundreds of single depth simulations (e.g., 3,000 seconds (50 minutes) to 12,000 seconds (200 minutes) or more). One approach is to perform an analysis at intervals of 100 ft (approximately 30 meters) from start depth to end depth of the run. BHA tendency can demand two types of calculations: full steering tendency and zero steering tendency/neutral mode. As an example, to minimize the total simulation time, an application may aim to reduce the number of iterations by smartly selecting the analysis depth.

Figure 24:
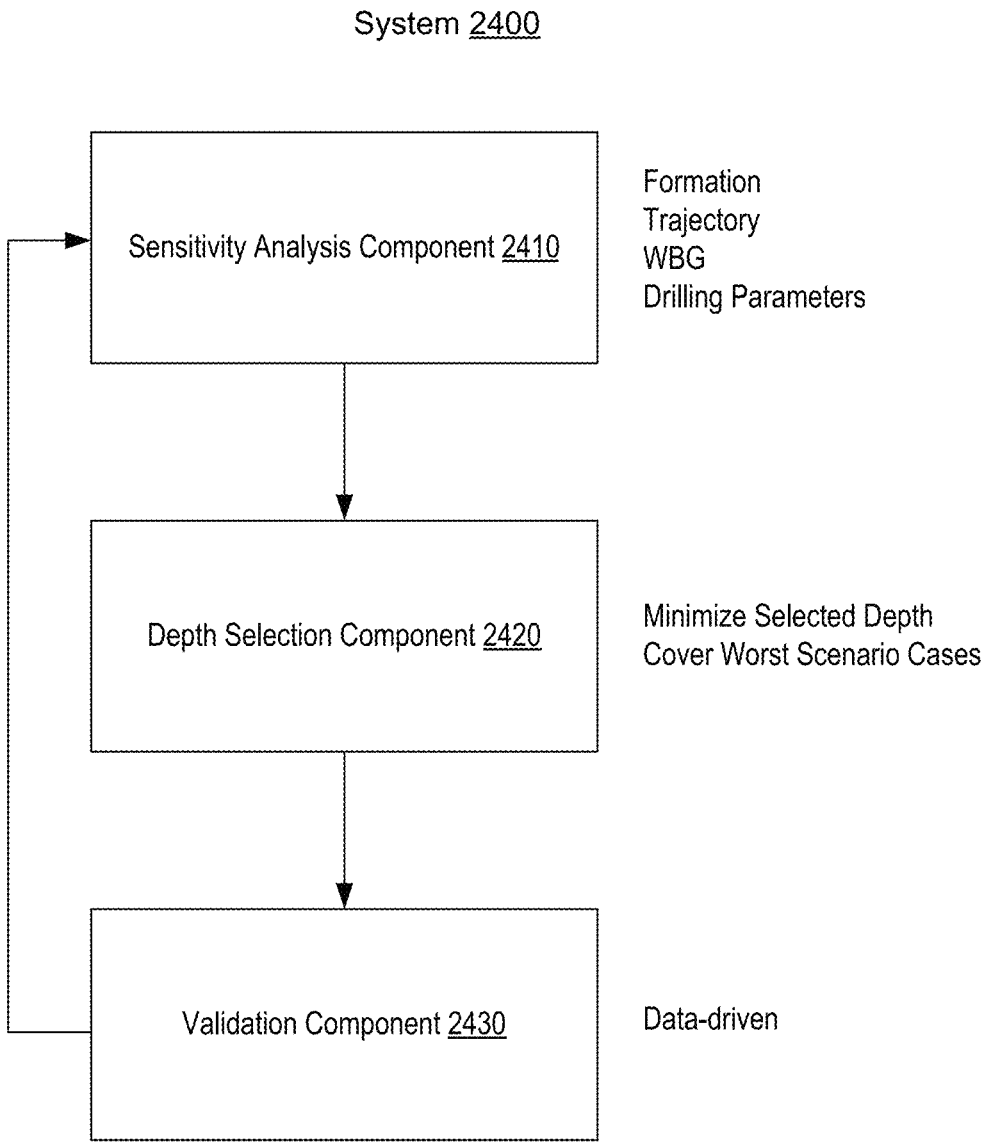
FIG. 24 illustrates an example of a system with respect to an example of a method.

FIG. 24 shows an example of a system 2400 that includes a sensitivity analysis component 2410, a depth selection component 2420 and a validation component 2430. Such components may operate according to a method where output of the sensitivity analysis component 2410 is received by the depth selection component 2420, which outputs information to the validation component 2430 for validation and optional looping back to the sensitivity analysis component 2410. As shown, the sensitivity analysis component 2410 can operate using formation, trajectory, WBG, and/or drilling parameter information. The depth selection component 2420 can operate to minimize a selected depth and/or to cover one or more "worst" scenario cases. The validation component 2430 can be, for example, data-driven.

The system 2400 can be utilized for smart depth selection. For example, first, the component 2410 can perform a sensitivity analysis to determine the major influence factors on tendency calculations where a change of this factor can demand extra analysis depths. Next, the component 2420 builds an appropriate depth selection algorithm to perform depth selection in which an objective is to minimize the count of selected depths while still covering worst cases. Then, the validation component 2430 validates the depth selection algorithm in a data-driven manner for validation thereof (e.g., appropriateness, accuracy, etc.). The system 2400 can implement an iterative loop to help assure that the depth selection algorithm that is built is sufficiently valid.

Figure 25:
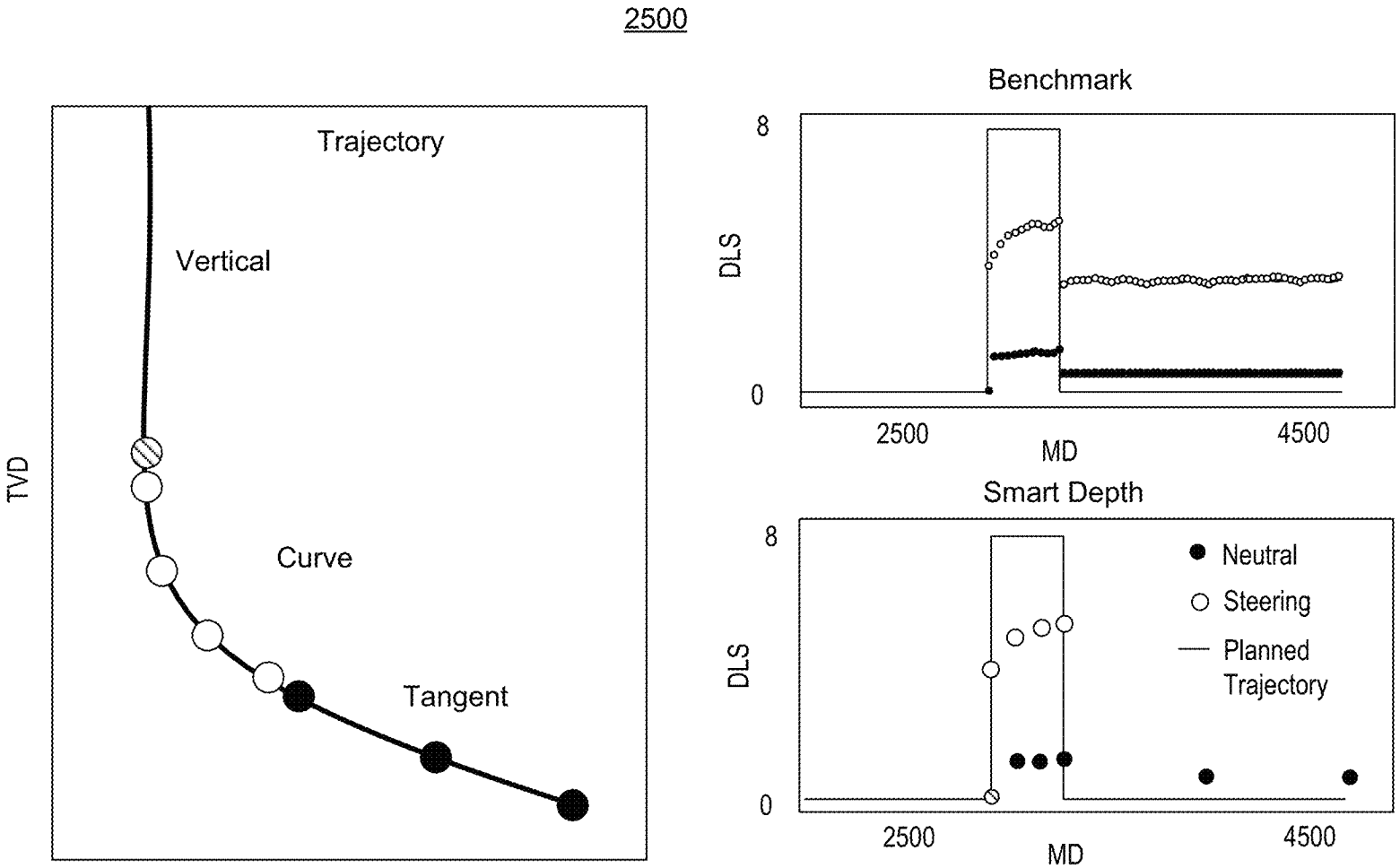
FIG. 25 illustrates an example of a graphical user interface.

FIG. 25 shows an example of a graphical user interface (GUI) 2500 that includes various information for BHA tendency calculations. As shown, a method can involve choosing trajectory features as factors for consideration in depth selection. The GUI 2500 shows a trajectory with a vertical portion, a curved portion and a tangent portion as part of a directional drilling job to drill a borehole. In the example shown, various points are indicated, some of which are along the curved section, which demand steering (e.g., steering while drilling). As steering is demanded, tendency can be a factor for planning and/or drilling. As an example, for each of the different trajectory sections, a different strategy for selecting the analysis depths may be utilized. The GUI 2500 shows two plots, one of which is labeled benchmark and the other smart depth. These plots demonstrate how selected depths can be validated. As shown in the smart depth plot, which includes depths selected by a depth selection algorithm plotted as DLS versus measured depth (MD), the curved section of the trajectory involves a higher DLS than the other sections. The plot of the trajectory may be with respect to true vertical depth (TVD) where coded markers can indicate where depths are selected in both a TVD plot and a MD plot. While depths are utilized, as an example, time may be utilized where a planned time and/or operational time can be linked to depth (e.g., TVD and/or MD).

In the example of FIG. 25, the benchmark plot can be derived from a database such as, for example, the North America Land Wells Database. Such a database can be utilized in a data-driven manner to validate a depth selection algorithm. In the benchmark plot of FIG. 25, about 600 real well design cases are used for the validation. Those cases covered the main steering tools and different kinds of the trajectory profiles. The benchmark plot and the smart depth plot show a validation result in one case. The smart depth algorithm can notably reduce the count of calculation depths while still capturing the main trend of the result as seen by a comparison of the smart depths to the benchmark trend.

FIG. 26 shows an example of a table of values 2600 for the benchmark, smart depth and differential between the two approaches. Specifically, the table of values 2600 shows the statistical results of computation time from the smart depth algorithm versus the benchmark, which indicates that the tendency simulation performance can be improved substantially. As shown, the average calculation time can be reduced by approximately 90 percent (e.g., 1971 seconds (33 minutes) to 183 seconds (3 minutes)).

As explained, improved performance of a system can be achieved using a reduced order model from machine learning. As mentioned, mud driven motors are widely used for drilling directional wells, as well as enhancing drilling performance. A comprehensive simulation methodology can predict the power capabilities and fatigue life of a motor power section under downhole conditions with acceptable precision using a combination of the finite element method (FEM or FEA) and computational fluid dynamics (CFD) as well as lab test results to get a powerful simulator for the physical phenomenon, that can help with optimized power section design, pre-job motor selection, drilling parameters optimization etc. However, a single run of a simulation takes hours of computation time, which limits the usage of this simulator in well planning or real time monitoring applications.

One approach to speed up the simulation is to pre-compute a large amount of simulation scenarios and create a result database, which will allow user to quickly interpolate the results instead of running the simulation. However, that is not acceptable in terms of implementation, because as a rough estimation, in order to guarantee the accuracy, the number of simulation cases to be pre-computed will be huge, which is not acceptable.

As an example, a reduced order model (ROM) can be a simplification of a high-fidelity dynamical model that preserves particular behavior and dominant effects with a satisfactory accuracy in a manner that is accompanied by a reduction in demand for computational resources, time and storage capacity. As an example, a method can include creating a reduced order model for the simulator, by using machine learning on the simulation results.

Figure 27:
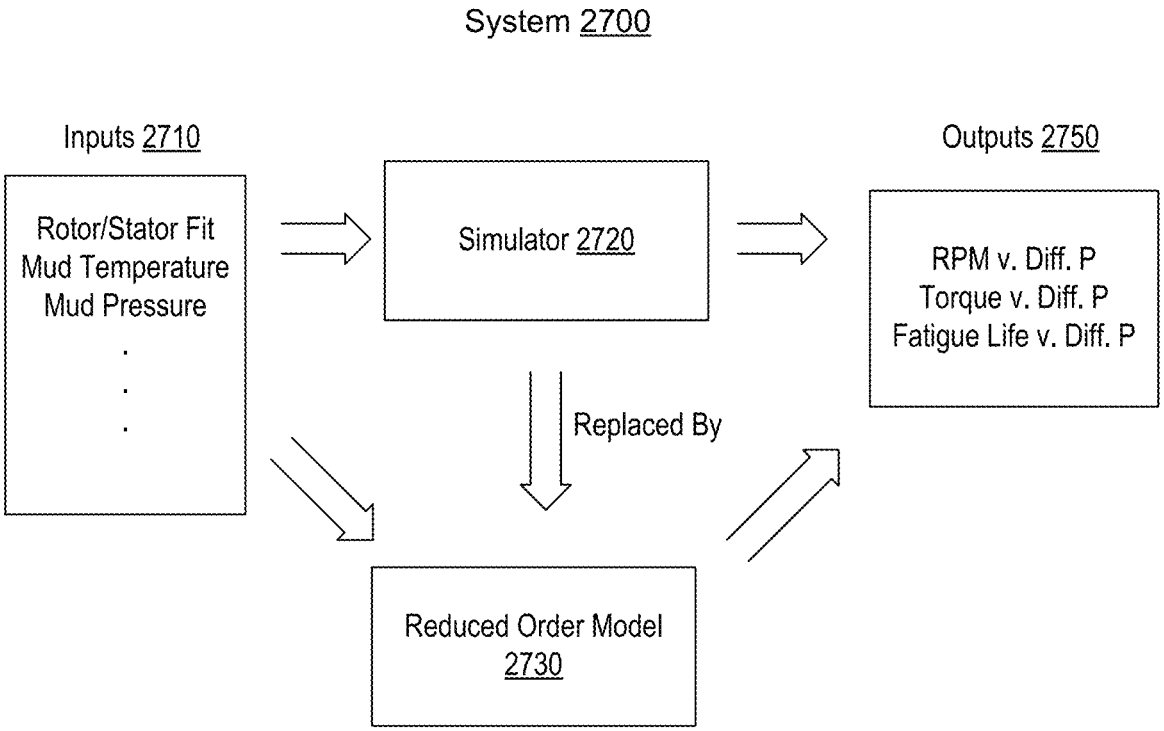
FIG. 27 illustrates an example of a system.

FIG. 27 shows an example of a system 2700 that includes inputs 2710, a simulator 2720, a reduced order model 2730, and outputs 2750. The reduced order model can be part of a computational framework such as, for example, the computational framework 2130 of FIG. 21. As shown in FIG. 27, the outputs 2750 may be with respect to a parameter such as differential pressure of a fluid driven motor (e.g., power section) of a directional drilling BHA.

As an example, a simulator can include features of a simulator as described in an article by Ba et al., entitled "Positive Displacement Motor Modeling: Skyrocketing the Way We Design, Select, and Operate Mud Motors", Abu Dhabi International Petroleum Exhibition and Conference, Abu Dhabi, UAE 7-10 Dec. 2016, SPE-183298-MS (doi.org/10.2118/183298-MS), which is incorporated by reference herein.

A method can include selecting features for machine learning and analyzing the inputs of the simulator 2720, for example, a few features that affect the power and fatigue life result can be selected. Next, the method can generate training data. For example, as machine learning tends to be acceptable for interpolation types of tasks, to get more accurate prediction results, the space of input parameters can to be acceptably sampled. For training one model, thousands of simulation scenarios (e.g., combinations of input parameters) can be prepared and the simulator 2720 can be run to generate the results, which can be in the form of three curves (e.g., RPM, torque and fatigue life versus differential pressure). The number of simulation scenarios may be obtained iteratively by looking at prediction accuracy. For different simulations or different input parameters, this number might change. However, compared with the lookup table method as mentioned, machine learning demands fewer simulation scenarios (e.g., about 1/10 in this case). The method can then proceed to train the machine learning model. For example, based on the simulation results, machine learning models can be trained to predict the outputs. As an example, neural network regression can be used. A trained model learning model (ML model) can be validated. For example, a trained machine learning model can be validated by comparing results with original simulation results.

FIG. 28 shows an example of a table of values 2800 with validation results for three types of fluid motor power sections. The validation result suggests that a trained ML model can predict a power curve (RPM & Torque) with a median error of less than 1% and predict fatigue life curve with a median error of less than 5% where the average accuracy is about 98%. Compared to the original simulation time, the time to get results from machine learning model is of the order of a few milliseconds.

As an example, a framework can implement one or more approaches to reduce computational resource demands, which can facilitate planning, monitoring and/or operations. Such approaches can be implemented to improve the performance of drilling simulations via smart depth selection strategy for BHA tendency calculation and via reduced order model using machine learning for motor optimization modeling.

To reduce the overall computation time, an approach can use logic to smartly select analysis depth(s) which can detect if a contributing input changed and potentially gave different result. This approach is demonstrated through successful implementation in BHA tendency calculations where a 100% speed improvement was achieved.

As to a reduced order model, machine learning can be used as method to develop a reduced order model (ROM) for downhole motor optimization modeling, etc. Results demonstrate an ability to substantially reduce simulation time from hours to a few milliseconds, with about 98% accuracy. Besides the accuracy and fast response, machine learning model (ML model) can be relatively easy to deploy and can be re-trained rapidly when an original simulator is updated, etc.

Figure 29:
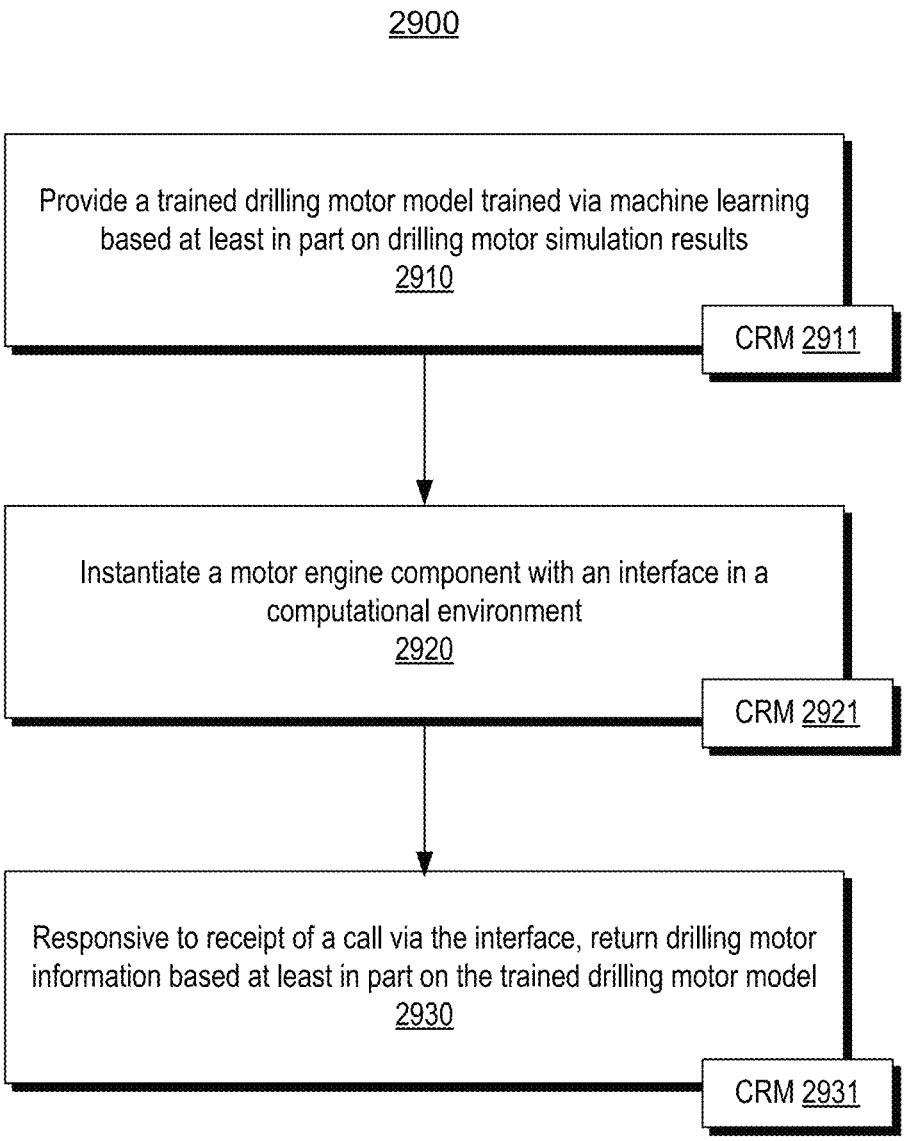
FIG. 29 illustrates an example of a method.

FIG. 29 shows an example of a method 2900 that includes a provision block 2910 for providing a trained drilling motor model trained via machine learning based at least in part on drilling motor simulation results; an instantiation block 2920 for instantiating a motor engine component with an interface in a computational environment; and a return block 2930 for, responsive to receipt of a call via the interface, returning drilling motor information based at least in part on the trained drilling motor model.

FIG. 29 also shows various computer-readable media (CRM) blocks 2911, 2921, and 2931. Such blocks can include instructions that are executable by one or more processors, which can be one or more processors of a computational framework, a system, a computer, etc. A computer-readable medium can be a computer-readable storage medium that is not a signal, not a carrier wave and that is non-transitory. For example, a computer-readable medium can be a physical memory component that can store information in a digital format. As an example, the instructions 796 of the system 790 of FIG. 7 can include instructions of one or more of the CRM blocks 2911, 2921, and 2931 such that the system 790 can perform one or more actions of the method 2900 of FIG. 29. As an example, a system can be a server system in a client-server architecture where a call can be made by a client device and received by a server that can respond to the call by returning requested information. As an example, a server can include computational resources for instantiating a motor engine with an interface such as an application programming interface (API) that can receive a call (e.g., via a network such as the Internet, etc.). In such an example, the motor engine can implement a trained drilling motor model to generate a result responsive to a call and/or information included in a call. In response to the call, the server can transmit the result to the caller (e.g., a client device, etc.). In a workflow, a user of a client device may interact with a framework using a graphical user interface where interactions generate rendered results in real time. For example, a user may interact with a feature of the framework where a result as to a drilling motor is rendered in an expeditious manner (e.g., within a few seconds, etc.). As an example, consider the GUI 1800 of FIG. 18, which may render information as to one or more drilling motors. During a drilling operation, such a GUI may render information as to depth, fatigue life, differential pressure, etc. Such a GUI may render information in real time during drilling where drilling may optionally be controlled using at least a portion of such rendered information. As an example, an operator may drill in a manner whereby fatigue life is deemed appropriate for a desired rate of penetration, DLS, etc. Such drilling may include changing one or more variables that can affect how a power section of a drillstring operates (see, e.g., FIG. 10).

As an example, a method can include receiving simulation results for a drilling motor; training a drilling motor model via machine learning based at least in part on the simulation results; instantiating a motor engine component with an interface in a computational environment; and, responsive to receipt of a call via the interface, returning drilling motor information based at least in part on the trained drilling motor model. Such a method can include rendering at least a portion of the information to a graphical user interface. In such an example, the method can include selecting a drilling motor based at least in part on at least a portion of the render information.

As an example, a method can include outputting information that includes drilling motor fatigue information. For example, consider fatigue information that includes fatigue information for an elastomeric material. In such an example, information may include or be based at least in part on compatibility information of an elastomeric material with a drilling fluid (e.g., drilling mud).

As an example, information output by a method can include one or more operational parameters. In such an example, the method can include transmitting at least one of the one or more operational parameters to a piece of equipment that performs a drilling operation.

As an example, a method can include rendering information to a display where the information includes control information for controlling a drilling motor during a drilling operation. In such an example, the drilling operation can be or include a directional drilling operation.

As an example, a method can include selecting a type of drilling motor based at least in part on the information and building a bottom hole assembly that includes the type of drilling motor.

As an example, simulation results can include computational fluid dynamics based results and/or computational finite element analysis based results.

As an example, a method can include rendering a performance monitoring graphic to a display during a drilling operation that utilizes a type of drilling motor selected based at least in part on information received responsive to an API or other type of call to an interface.

As an example, information returned from a motor engine component can include one or more of rate of penetration information for a type of drilling motor, an estimated life time for a type of drilling motor, a risk of failure for a type of drilling motor, and a cost for a type of drilling motor.

As an example, a method can include providing a trained drilling motor model trained via machine learning based at least in part on drilling motor simulation results; instantiating a motor engine component with an interface in a computational environment; and, responsive to receipt of a call via the interface, returning drilling motor information based at least in part on the trained drilling motor model. In such an example, the method can include rendering at least a portion of the information to a graphical user interface and, for example, selecting a drilling motor based at least in part on at least a portion of the rendered information.

As an example, a method can include generating drilling motor fatigue information using a motor engine with a trained drilling motor model where, for example, the fatigue information includes fatigue information for an elastomeric material of a stator of a fluid driven power section. In such an example, the trained drilling motor model can be a machine learning model (ML model), which may be a trained neural network model (see, e.g., FIG. 22). As an example, fatigue information can be for elastomeric material, which can be fatigue information that accounts for compatibility information associated with a drilling fluid.

As an example, a method can include generating information that includes one or more operational parameters. For example, consider generating one or more operational parameters using a trained drilling motor model and transmitting at least one of the one or more operational parameters to a piece of equipment that performs a drilling operation. For example, consider an operational parameter value that can be utilized to adjust a pump rate of a fluid pump, a characteristic of a drilling fluid (e.g., viscosity, etc.), a pressure, etc.

As an example, a method can include rendering information to a display where the information includes control information for controlling a drilling motor during a drilling operation. In such an example, the drilling operation can include a directional drilling operation. For example, consider a directional drilling operation that can aim to drill a portion of a borehole according to a trajectory that specifies a DLS.

As an example, a method can include selecting a type of drilling motor based at least in part on information generated by a motor engine that includes or is operatively coupled to a trained drilling motor model and building a bottom hole assembly that includes the type of drilling motor.

As an example, drilling motor simulation results can include computational fluid dynamics based results and/or computational finite element analysis based results.

As an example, a method can include rendering a performance monitoring graphic to a display during a drilling operation that utilizes a type of drilling motor selected based at least in part on drilling motor information as generated via a call to a motor engine (e.g., via an API, etc.) that uses a trained drilling motor model.

As an example, drilling motor information can include rate of penetration information for a type of drilling motor, an estimated life time for a type of drilling motor, a risk of failure for a type of drilling motor, and/or a cost for a type of drilling motor.

As an example, a system can include a processor; memory accessible by the processor; processor-executable instructions stored in the memory and executable to instruct the system to: receive simulation results for a drilling motor; train a drilling motor model via machine learning based at least in part on the simulation results; instantiate a motor engine component with an interface in a computational environment; and, responsive to receipt of a call via the interface, return drilling motor information based at least in part on the trained drilling motor model.

As an example, one or more computer-readable storage media can include processor-executable instructions to instruct a computing system to: receive simulation results for a drilling motor; train a drilling motor model via machine learning based at least in part on the simulation results; instantiate a motor engine component with an interface in a computational environment; and, responsive to receipt of a call via the interface, return drilling motor information based at least in part on the trained drilling motor model.

As an example, a method may be implemented in part using computer-readable media (CRM), for example, as a module, a block, etc. that include information such as instructions suitable for execution by one or more processors (or processor cores) to instruct a computing device or system to perform one or more actions. As an example, a single medium may be configured with instructions to allow for, at least in part, performance of various actions of a method. As an example, a computer-readable medium (CRM) may be a computer-readable storage medium (e.g., a non-transitory medium) that is not a carrier wave.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 30:
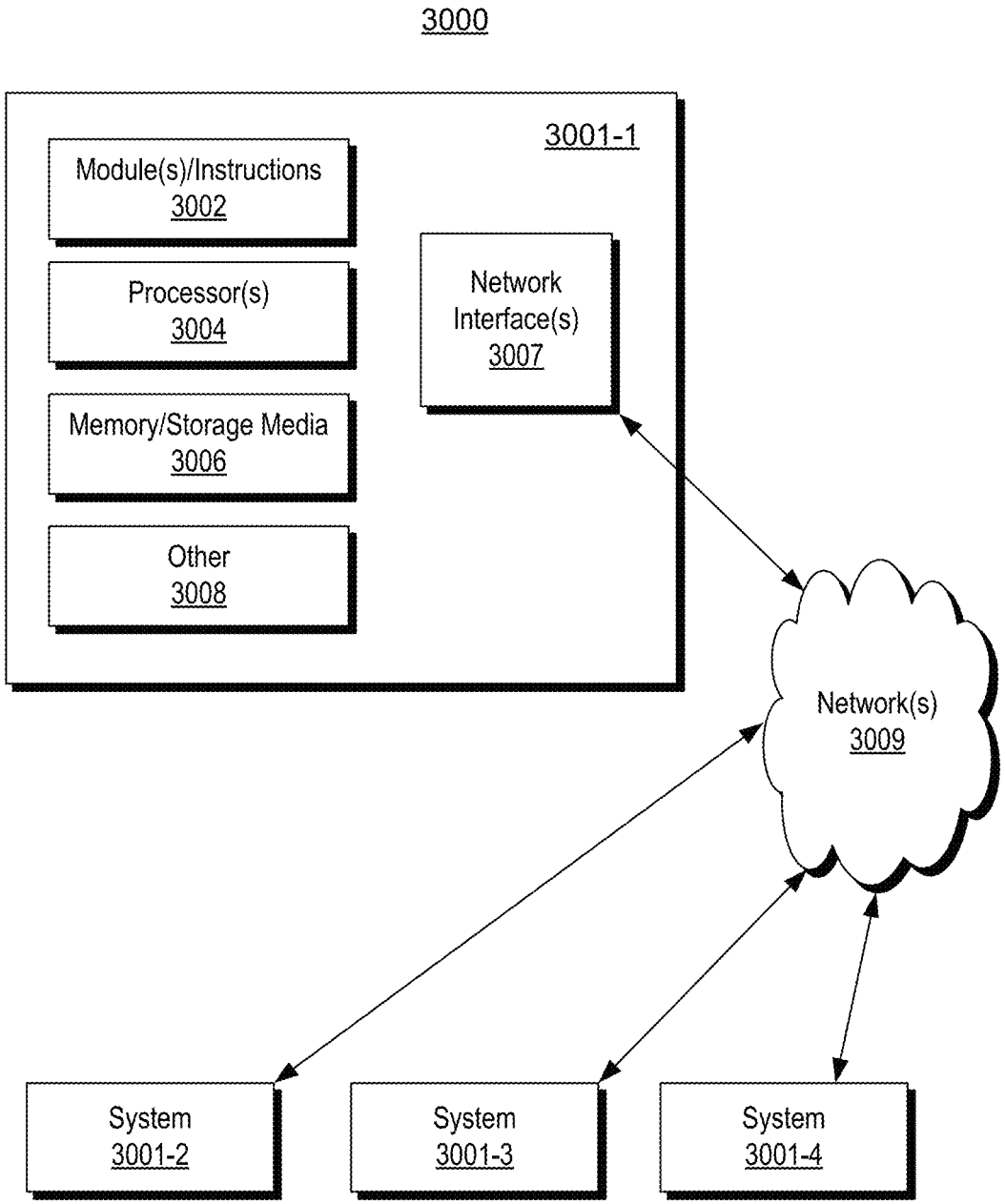
FIG. 30 illustrates an example of computing system.

In some embodiments, a method or methods may be executed by a computing system. FIG. 30 shows an example of a system 3000 that can include one or more computing systems 3001-1, 3001-2, 3001-3 and 3001-4, which may be operatively coupled via one or more networks 3009, which may include wired and/or wireless networks.

As an example, a system can include an individual computer system or an arrangement of distributed computer systems. In the example of FIG. 30, the computer system 3001-1 can include one or more modules 3002, which may be or include processor-executable instructions, for example, executable to perform various tasks (e.g., receiving information, requesting information, processing information, simulation, outputting information, etc.).

As an example, a module may be executed independently, or in coordination with, one or more processors 3004, which is (or are) operatively coupled to one or more storage media 3006 (e.g., via wire, wirelessly, etc.). As an example, one or more of the one or more processors 3004 can be operatively coupled to at least one of one or more network interface 3007. In such an example, the computer system 3001-1 can transmit and/or receive information, for example, via the one or more networks 3009 (e.g., consider one or more of the Internet, a private network, a cellular network, a satellite network, etc.).

As an example, the computer system 3001-1 may receive from and/or transmit information to one or more other devices, which may be or include, for example, one or more of the computer systems 3001-2, etc. A device may be located in a physical location that differs from that of the computer system 3001-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 3006 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general purpose processors or application specific chips (e.g., or chipsets), such as ASICs, FPGAs, PLDs, or other appropriate devices.

Figure 31:
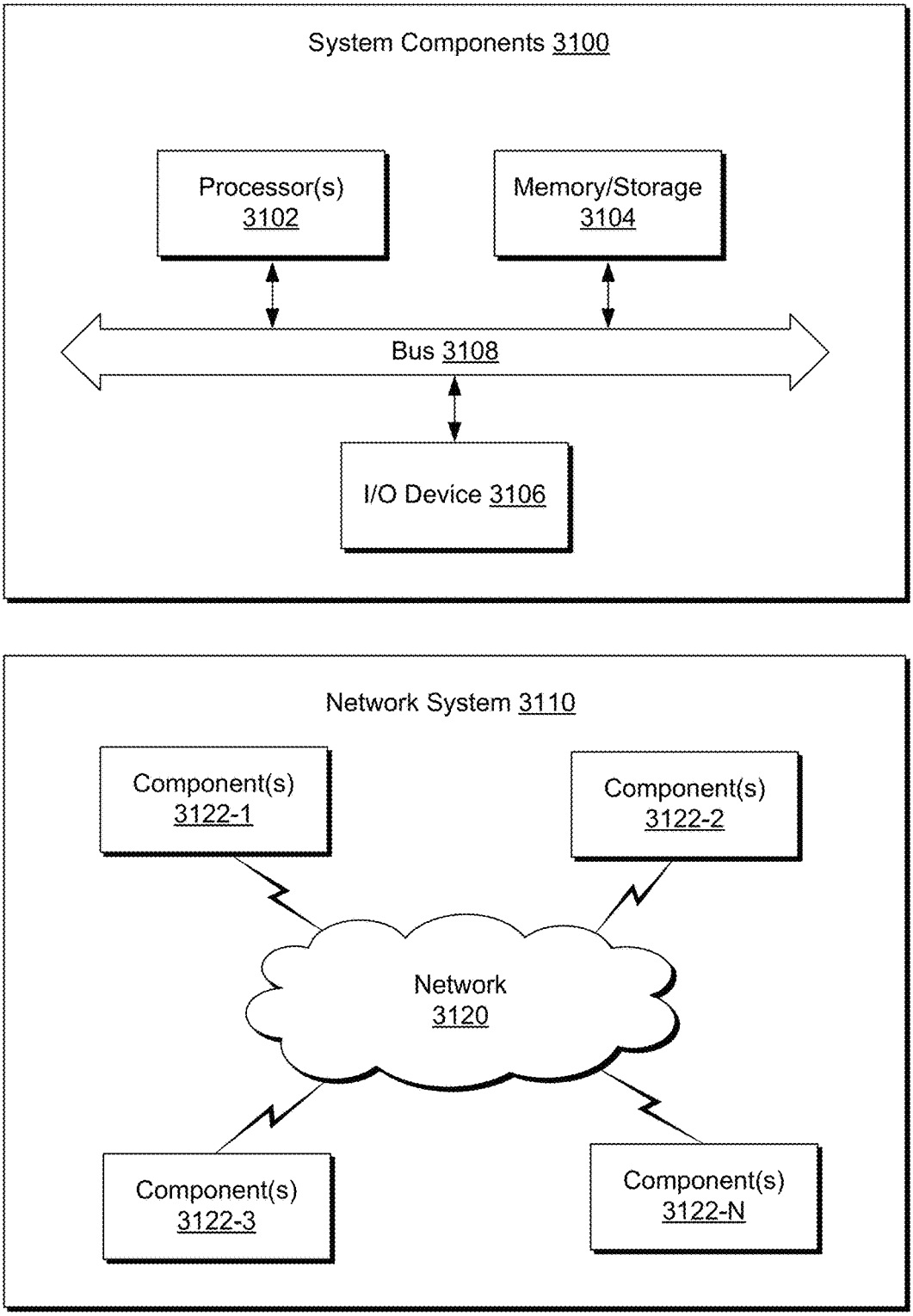
FIG. 31 illustrates example components of a system and a networked system.

FIG. 31 shows components of a computing system 3100 and a networked system 3110. The system 3100 includes one or more processors 3102, memory and/or storage components 3104, one or more input and/or output devices 3106 and a bus 3108. According to an embodiment, instructions may be stored in one or more computer-readable media (e.g., memory/storage components 3104). Such instructions may be read by one or more processors (e.g., the processor(s) 3102) via a communication bus (e.g., the bus 3108), which may be wired or wireless. The one or more processors may execute such instructions to implement (wholly or in part) one or more attributes (e.g., as part of a method). A user may view output from and interact with a process via an I/O device (e.g., the device 3106). According to an embodiment, a computer-readable medium may be a storage component such as a physical memory storage device, for example, a chip, a chip on a package, a memory card, etc.

According to an embodiment, components may be distributed, such as in the network system 3110. The network system 3110 includes components 3122-1, 3122-2, 3122-3, . . . 3122-N. For example, the components 3122-1 may include the processor(s) 3102 while the component(s) 3122-3 may include memory accessible by the processor(s) 3102. Further, the component(s) 3122-2 may include an I/O device for display and optionally interaction with a method. The network may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A method comprising:

receiving, by a computational framework, well data for drilling a well at a wellsite, wherein the computational framework comprises a downhole condition simulator, a bit behavior simulator, and a trained drilling motor model trained via machine learning based at least in part on drilling motor simulation results, wherein the trained drilling motor model is a proxy for a drilling motor simulator that generates the drilling motor simulation results;

generating downhole condition simulation results for temperature, pressure and motor flow rate using the downhole condition simulator and at least a portion of the well data;

generating bit behavior simulation results using the bit behavior simulator and at least a portion of the well data;

instantiating a motor engine component with an interface in a computational environment operatively coupled to the computational framework; and responsive to receipt of a call via the interface, returning drilling motor information from the computational framework based at least in part on execution of the trained drilling motor model using the downhole conditions simulation results and the bit behavior simulation results as input, wherein the drilling motor information comprises motor performance information and motor fatigue information for drilling the well at the wellsite.

2. The method of claim 1 comprising rendering at least a portion of the drilling motor information to a graphical user interface.

3. The method of claim 2 comprising selecting a drilling motor based at least in part on at least a portion of the rendered drilling motor information.

4. The method of claim 1 wherein the motor fatigue information comprises fatigue information for an elastomeric material of a stator of a fluid driven power section.

5. The method of claim 4 wherein the fatigue information for the elastomeric material comprises compatibility information associated with a drilling fluid.

6. The method of claim 1 wherein the drilling motor information comprises one or more operational parameters.

7. The method of claim 6 comprising transmitting at least one of the one or more operational parameters to a piece of equipment that performs a drilling operation.

8. The method of claim 1 comprising rendering information to a display wherein the information comprises control information for controlling a drilling motor during a drilling operation.

9. The method of claim 8 wherein the drilling operation comprises a directional drilling operation.

10. The method of claim 1 comprising selecting a type of drilling motor based at least in part on the drilling motor information and building a bottom hole assembly that comprises the type of drilling motor.

11. The method of claim 1 wherein the drilling motor simulation results comprise computational fluid dynamics based results.

12. The method of claim 1 wherein the drilling motor simulation results comprise computational finite element analysis based results.

13. The method of claim 1 comprising rendering a performance monitoring graphic to a display during a drilling operation that utilizes a type of drilling motor selected based at least in part on the drilling motor information.

14. The method of claim 1 wherein the drilling motor information comprises rate of penetration information for a type of drilling motor.

15. The method of claim 1 wherein the drilling motor information comprises an estimated life time for a type of drilling motor.

16. The method of claim 1 wherein the drilling motor information comprises a risk of failure for a type of drilling motor.

17. The method of claim 1 wherein the drilling motor information comprises a cost for a type of drilling motor.

18. The method of claim 1, wherein the motor performance information comprises a power curve and wherein the motor fatigue information comprises a fatigue life curve.

19. A system comprising:

a processor;

memory accessible by the processor;

processor-executable instructions stored in the memory and executable to instruct the system to:

access a downhole condition simulator, a bit behavior simulator, and a trained drilling motor model trained via machine learning based at least in part on drilling motor simulation results, wherein the trained drilling motor model is a proxy for a drilling motor simulator that generates the drilling motor simulation results;

receive well data for drilling a well at a wellsite;

generate downhole condition simulation results for temperature, pressure and motor flow rate using the downhole condition simulator and at least a portion of the well data;

generate bit behavior simulation results using the bit behavior simulator and at least a portion of the well data instantiate a motor engine component with an interface in a computational environment; and responsive to receipt of a call via the interface, return drilling motor information based at least in part on execution of the trained drilling motor model using the downhole conditions simulation results and the bit behavior simulation results as input, wherein the drilling motor information comprises motor performance information and motor fatigue information for drilling the well at the wellsite.

20. One or more computer-readable storage media comprising processor-executable instructions to instruct a computing system to:

access a downhole condition simulator, a bit behavior simulator, and a trained drilling motor model trained via machine learning based at least in part on drilling motor simulation results, wherein the trained drilling motor model is a proxy for a drilling motor simulator that generates the drilling motor simulation results;

receive well data for drilling a well at a wellsite;

generate downhole condition simulation results for temperature, pressure and motor flow rate using the downhole condition simulator and at least a portion of the well data;

generate bit behavior simulation results using the bit behavior simulator and at least a portion of the well data instantiate a motor engine component with an interface in a computational environment; and responsive to receipt of a call via the interface, return drilling motor information based at least in part on execution of the trained drilling motor model using the downhole conditions simulation results and the bit behavior simulation results as input, wherein the drilling motor information comprises motor performance information and motor fatigue information for drilling the well at the wellsite.

* * * * *